US010940700B2

(12) United States Patent
Miyakoshi

(10) Patent No.: US 10,940,700 B2
(45) Date of Patent: Mar. 9, 2021

(54) DECURLING DEVICE AND IMAGE FORMING APPARATUS INCLUDING SAME

(71) Applicant: KYOCERA Document Solutions Inc., Osaka (JP)

(72) Inventor: Naoto Miyakoshi, Osaka (JP)

(73) Assignee: KYOCERA Document Solutions Inc.

( * ) Notice: Subject to any disclaimer, the term of this patent is extended or adjusted under 35 U.S.C. 154(b) by 0 days.

(21) Appl. No.: 16/718,297

(22) Filed: Dec. 18, 2019

(65) Prior Publication Data

US 2020/0198371 A1 Jun. 25, 2020

(30) Foreign Application Priority Data

Dec. 25, 2018 (JP) ..... JP2018-240976

(51) Int. Cl.

| | |
|---|---|
| ***B41J 11/00*** | (2006.01) |
| ***B41J 13/02*** | (2006.01) |
| ***B41J 29/38*** | (2006.01) |
| ***B65H 5/06*** | (2006.01) |
| *B41J 29/02* | (2006.01) |

(52) U.S. Cl.

CPC ..... *B41J 11/0005* (2013.01); *B41J 13/02* (2013.01); *B41J 29/38* (2013.01); *B65H 5/062* (2013.01); *B41J 29/02* (2013.01); *B41J 2202/20* (2013.01); *B65H 2301/51256* (2013.01)

(58) Field of Classification Search

CPC ..... B41J 11/0005; B41J 13/02; B41J 29/38; B41J 2202/20; B41J 29/02; B65H 5/062; B65H 2301/51256

See application file for complete search history.

(56) References Cited

U.S. PATENT DOCUMENTS 5,287,157 A * 2/1994 Miyazato ..... G03G 15/6576 162/197
5,565,971 A * 10/1996 Kuo ..... B65H 29/12 162/197
2009/0003912 A1* 1/2009 Nagasaki ..... G03G 15/6576 399/406

FOREIGN PATENT DOCUMENTS

JP 4-338060 11/1992

* cited by examiner

*Primary Examiner* — Yaovi M Ameh
(74) *Attorney, Agent, or Firm* — Gerald E. Hespos; Michael J. Porco; Matthew T. Hespos

(57) ABSTRACT

A decurling device includes a first frame, a second frame, a decurling unit that decurls a sheet, and a level adjustment mechanism that is capable of adjusting an inclination of the decurling unit. The decurling unit includes a housing provided with a first support part and a second support part supported by the first frame and a third support part and a fourth support part supported by the second frame, paired support rollers, an endless belt, and a decurling roller. The level adjustment mechanism adjusts, in the vertical direction, a position of one of the first support part, the second support part, the third support part, and the fourth support part in the housing to adjust the inclination of the decurling unit in the vertical direction such that the paired support rollers extend in the first direction.

6 Claims, 15 Drawing Sheets

DECURLING DEVICE AND IMAGE FORMING APPARATUS INCLUDING SAME

INCORPORATION BY REFERENCE

This application is based on Japanese Patent Application No. 2018-240976 filed on Dec. 25, 2018, the entire content of which is incorporated herein by reference.

BACKGROUND

Field of the Invention

The present disclosure relates to a decurling device that decurls a sheet having an image formed thereon and an image forming apparatus including the decurling device.

Related Art

An image forming apparatus, such as a printer, that includes a decurling device that decurls a sheet having an image formed thereon has been known.

A conventional decurling device includes an endless belt stretched on a pair of support rollers and a decurling roller (pressing roller) that press-contacts an outer circumferential surface of the endless belt. In the decurling device, as a sheet passes through a nip formed by the decurling roller press-contacting the endless belt, the sheet is decurled.

SUMMARY

A decurling device according to one aspect of the present disclosure includes a first frame, a second frame, a decurling unit, and a level adjustment mechanism. The first frame and the second frame are disposed to face each other with an interval in a first direction in a horizontal plane and extend in a second direction orthogonal to the first direction. The decurling unit is supported by the first frame and the second frame and decurls a sheet on which an image is formed. The level adjustment mechanism is capable of adjusting an inclination of the decurling unit to a vertical direction with respect to the first direction.

The decurling unit includes a housing, paired support rollers, an endless belt, and a decurling roller. The housing is disposed between the first frame and the second frame including a first end portion and a second end portion in the first direction, a first support part and a second support part that are spaced apart from each other in the second direction at the first end portion and are supported by the first frame, and a third support part and a fourth support part that are spaced apart from each other in the second direction at the second end portion and are supported by the second frame. The paired support rollers are disposed in the housing to be spaced apart from each other in the second direction, each of the paired support rollers extending in the first direction and including end portions that are rotatably supported at the first end portion and the second end portion of the housing. The endless belt is stretched on the paired support rollers and circulates according to rotation of the paired support rollers. The decurling roller press-contacts an outer circumferential surface of the endless belt between the paired support rollers to form a nip that has a curved shape together with the endless belt.

The level adjustment mechanism adjusts, in the vertical direction, a position of one of the first support part, the second support part, the third support part, and the fourth support part in the housing to adjust the inclination of the decurling unit in the vertical direction such that the paired support rollers extend in the first direction.

An image forming apparatus according to another aspect of the present disclosure includes an image forming unit that forms an image on a sheet and the decurling device that decurls a sheet on which an image is formed by the image forming unit.

DETAILED DESCRIPTION

A decurling device and an image forming apparatus according to an embodiment of the present disclosure will be described in detail below with reference to the drawings. Directional relationships will be described below by using XYZ orthogonal coordinate axes. The X-axis direction indicates a first direction on a horizontal plane, the Y-axis direction indicates a second direction that is orthogonal to the X-axis direction on the horizontal plane, and the Z-axis direction indicates a vertical direction that is orthogonal to the X-axis direction and the Y-axis direction. One direction side of the X-axis direction is referred to as "+X side", whereas the other direction side of the X-axis direction that is opposite to the one direction side is referred to as "−X side". In addition, one direction side of the Y-axis direction is referred to as "+Y side", whereas the other direction side of the Y-axis direction that is opposite to the one direction side is referred to as "−Y side". Moreover, a vertically upward side that is one direction side of the Z-axis direction is referred to as "+Z side", whereas a vertically downward side that is the other direction side of the Z-axis direction opposite to the one direction side is referred to as "−Z side".

[Overall Configuration of Image Forming Apparatus]

Figure 1:
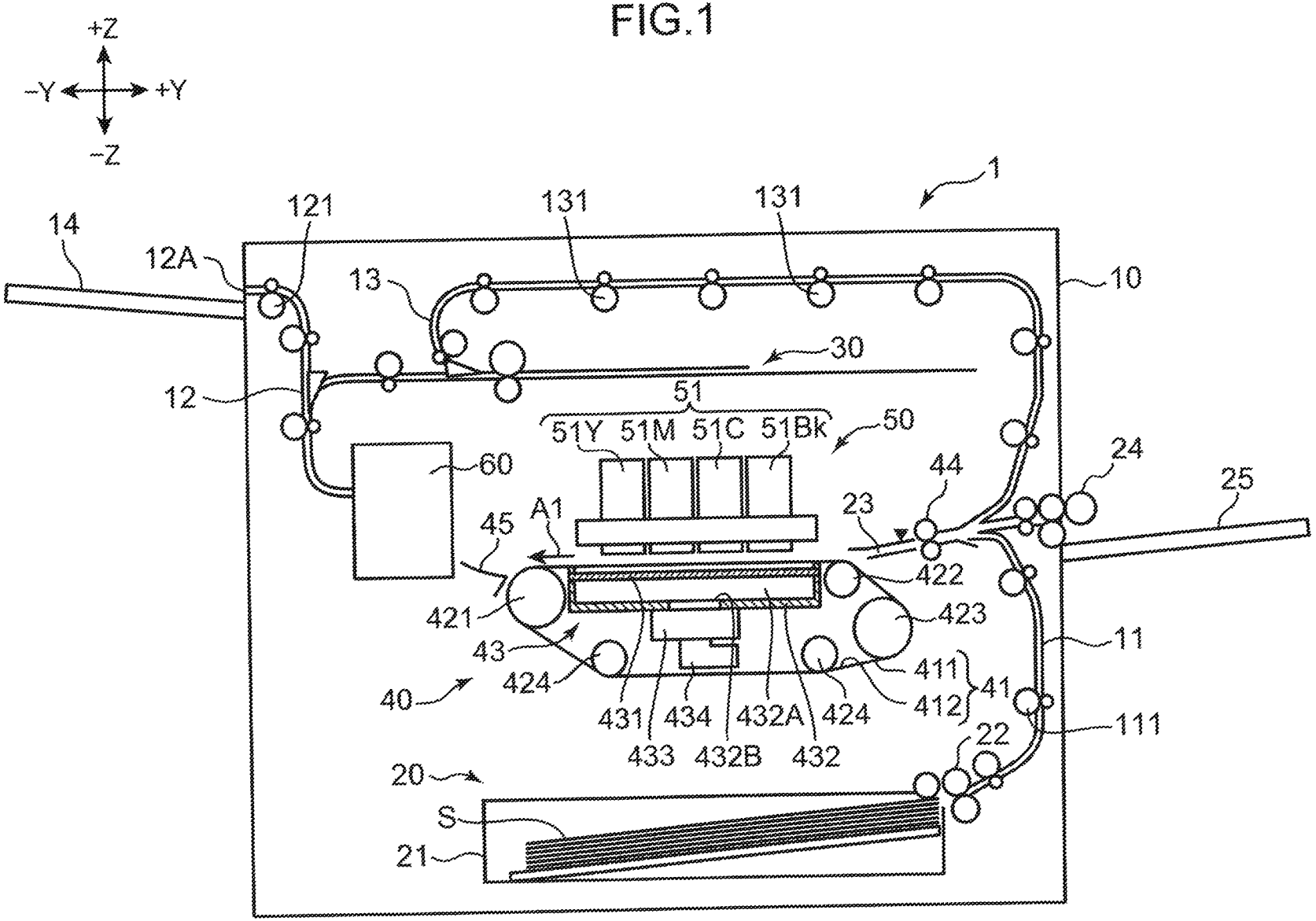
FIG. 1 illustrates an internal configuration of an image forming apparatus according to an embodiment of the present disclosure.

FIG. 1 illustrates an internal configuration of an image forming apparatus 1 according to an embodiment of the present disclosure. The image forming apparatus 1 illustrated in FIG. 1 is an ink-jet recording apparatus that ejects ink droplets to form (record) an image on a sheet S. The image forming apparatus 1 includes an apparatus body 10, a sheet feeder 20, a sheet inverter 30, a sheet conveyor 40, an image forming unit 50, and a decurling device 60.

The apparatus body 10 is a box-shaped casing that houses various devices for forming an image on the sheet S. The apparatus body 10 includes a first conveyance path 11, a second conveyance path 12, and a third conveyance path 13 that are conveyance paths for the sheet S.

The sheet feeder 20 feeds the sheet S to the first conveyance path 11. The sheet feeder 20 includes a sheet feeding cassette 21 and a pickup roller 22.

The sheet S fed to the first conveyance path 11 is conveyed to a registration roller pair 44 of the sheet conveyor 40 by a first conveyance roller pair 111 on the first conveyance path 11, the registration roller pair 44 being disposed at a downstream end of the conveyance path 11. The sheet S placed on a sheet feed tray 25 is sent to the registration roller pair 44 by a sheet feeding roller 24.

The registration roller pair 44 corrects a skew of the sheet S and at the same time, sends the sheet S to a conveying belt 41 through a sheet introduction guide 23 at a proper timing for the image forming unit 50 to perform image forming processing. The sheet introduction guide 23 guides the sheet S sent from the registration roller pair 44 to an outer circumferential surface 411 of the conveying belt 41 in the sheet conveyor 40.

When a leading end of the sheet S guided by the sheet introduction guide 23 contacts the outer circumferential surface 411 of the conveying belt 41, the sheet S is held on the outer circumferential surface 411 by the conveying belt 41 driven and conveyed in a sheet conveyance direction A1. The sheet conveyance direction A1 is a direction from the +Y side to the −Y side in the Y-axis direction.

The sheet conveyor 40 is disposed on the −Z side of the image forming unit 50 so as to face a line head 51. The sheet conveyor 40 conveys the sheet S, which has been guided and introduced by the sheet introduction guide 23, in the sheet conveyance direction A1 so that the sheet S passes on the −Z side of the image forming unit 50. The sheet conveyor 40 includes the conveying belt 41 and a suction unit 43 in addition to the registration roller pair 44.

The conveying belt 41 is an endless belt having a width in the X-axis direction and extending in the Y-axis direction. The conveying belt 41 is disposed so as to oppose the image forming unit 50 and conveys the sheet S on the outer circumferential surface 411 in the sheet conveyance direction A1.

The conveying belt 41 is stretched over a first roller 421, a second roller 422, a third roller 423, and a pair of fourth rollers 424. The suction unit 43 is disposed inside of the conveying belt 41 stretched so as to oppose an inner circumferential surface 412. The first roller 421 is a drive roller that extends in the X-axis direction, which is the width direction of the conveying belt 41, and is disposed on the downstream side of the suction unit 43 in the sheet conveyance direction A1. The first roller 421 is rotationally driven by a drive motor (not illustrated), thus circulating the conveying belt 41 in a predetermined circulating direction. As the conveying belt 41 circulates, the sheet S held on the outer circumferential surface 411 is conveyed in the sheet conveyance direction A1.

The second roller 422 is a belt speed detecting roller extending in the X-axis direction, and is disposed on the upstream side of the suction unit 43 in the sheet conveyance direction A1. The second roller 422 is disposed so as to keep flat a region on the outer circumferential surface 411 of the conveying belt 41 opposing the line head 51 and a region on the inner circumferential surface 412 of the conveying belt 41 opposing the suction unit 43, by cooperating with the first roller 421. The second roller 422 is rotated following the circulation of the conveying belt 41. A pulse plate (not illustrated) is attached to the second roller 422 and integrally rotates with the second roller 422. The rotating speed of the conveying belt 41 is detected by measuring a rotating speed of the pulse plate.

The third roller 423 is a tension roller that extends in the X-axis direction and applies tension to the conveying belt 41 to prevent the conveying belt 41 from sagging. The third roller 423 is rotated following the circulation of the conveying belt 41. Each of the pair of fourth rollers 424 is a guide roller that extends in the X-axis direction and guides the conveying belt 41 so that the conveying belt 41 passes below the suction unit 43. The pair of the fourth rollers 424 is rotated following the circulation of the conveying belt 41.

The conveying belt 41 has a plurality of suction holes that penetrate the conveying belt 41 in a thickness direction from the outer circumferential surface 411 to the inner circumferential surface 412.

The suction unit 43 is disposed to face the image forming unit 50 with the conveying belt 41 being interposed therebetween. The suction unit 43 generates a negative pressure between the sheet S held on the outer circumferential surface 411 of the conveying belt 41 and the conveying belt 41, so that the sheet S closely contacts the outer circumferential surface 411 of the conveying belt 41. The suction unit 43 includes a belt guide member 431, a suction casing 432, a suction device 433, and an exhaust duct 434.

The belt guide member 431 is disposed so as to face a region between the first roller 421 and the second roller 422 on the inner circumferential surface 412 of the conveying belt 41. The belt guide member 431 is a plate-shaped member that has a width approximately equal to a widthwise (X-axis direction) length of the conveying belt 41. In the region between the first roller 421 and the second roller 422, the belt guide member 431 guides the conveying belt 41 that circulates according to the rotation of the first roller 421.

The belt guide member 431 has a plurality of grooves formed in a belt guide surface that faces the inner circumferential surface 412 of the conveying belt 41. Each groove is formed so as to correspond to each suction hole of the conveying belt 41. The belt guide member 431 also includes through-holes corresponding to the grooves. The through-hole in the groove penetrates the belt guide member 431 in a thickness direction. The through-hole communicates with the suction hole of the conveying belt 41 via the groove.

The suction unit 43 with the configuration described above suctions air from a space on an upper side of the conveying belt 41 through the grooves and through-holes in the belt guide member 431 and the suction holes in the conveying belt 41, thus generating suction force. The suction force generates an airflow (suction airflow) toward the suction unit 43 in a space on the +Z side of the conveying belt 41. When the sheet S is guided by the sheet introduction guide 23 onto the conveying belt 41 and covers a part of the outer circumferential surface 411 of the conveying belt 41, the suction force (negative pressure) applied to the sheet S causes the sheet S to closely contact the outer circumferential surface 411 of the conveying belt 41.

The suction casing 432 is a box-shaped casing that is open to the +Z side. The suction casing 432 is disposed on the −Z side of the conveying belt 41 so as to cover the opening on the +Z side by the belt guide member 431. The suction casing 432 cooperates with the belt guide member 431 to define a suction space 432A. That is to say, the space surrounded by the suction casing 432 and the belt guide member 431 is the suction space 432A. The suction space 432A communicates with the suction holes in the conveying belt 41 through the grooves and through-holes in the belt guide member 431.

An opening 432B is formed in a bottom wall of the suction casing 432, and the suction device 433 is disposed at a position corresponding to the opening 432B. The exhaust duct 434 is connected to the suction device 433. The exhaust duct 434 is connected to an exhaust port (not illustrated) in the apparatus body 10.

The image forming unit 50 is disposed on the +Z side of the sheet conveyor 40. Specifically, the image forming unit 50 is disposed on the +Z side of the sheet conveyor 40 so as to face the outer circumferential surface 411 of the conveying belt 41. The image forming unit 50 performs image forming processing on the sheet S held on the outer circumferential surface 411 of the conveying belt 41 and conveyed in the sheet conveyance direction A1, thus forming an image on the sheet S. In the present embodiment, the image forming unit 50 forms an image by an ink-jet method, namely, by ejecting ink droplets to the sheet S.

The image forming unit 50 includes line heads 51Bk, 51C, 51M, and 51Y. The line head 51Bk ejects black ink droplets, the line head 51C ejects cyan ink droplets, the line head 51M ejects magenta ink droplets, and the line head 51Y ejects yellow ink droplets. The line heads 51Bk, 51C, 51M, and 51Y are collectively referred to as "line head 51" in some cases.

The line head 51 forms an image on the sheet S by ejecting ink droplets to the sheet S held on the outer circumferential surface 411 of the conveying belt 41 and conveyed in the sheet conveyance direction A1. The sheet S, on which an image is formed by the line head 51 ejecting ink droplets, is conveyed by the conveying belt 41 and guided by a sheet sending guide 45 to be sent to the decurling device 60. The decurling device 60 is disposed on the downstream side of the sheet sending guide 45 in the sheet conveyance direction A1 of the conveying belt 41. The decurling device 60 conveys the sheet S having an image formed thereon to the downstream side and at the same time, decurls the sheet S. The decurling device 60 will be described in detail later.

The sheet S having been decurled by the decurling device 60 is sent to the second conveyance path 12. The second conveyance path 12 extends along a side surface of the apparatus body 10 on the −Y side. The sheet S sent to the second conveyance path 12 is conveyed to a sheet output port 12A formed on the −Y side of the apparatus body 10 by a second conveyance roller pair 121 and is output from the sheet output port 12A onto a sheet output unit 14.

Meanwhile, when the sheet S sent to the second conveyance path 12 is to be subjected to duplex printing and image forming processing has been performed on a first surface (front surface) of the sheet S, the sheet S is sent to the sheet inverter 30. The sheet inverter 30 is a conveyance path that branches from the second conveyance path 12 on the way, and the sheet S is inverted (switchbacks) in the sheet inverter 30. The sheet S having been inverted upside down by the sheet inverter 30 is sent to the third conveyance path 13. The sheet S, which has been inverted upside down, is sent in the opposite direction by third conveyance roller pairs 131, and is supplied again onto the outer circumferential surface 411 of the conveying belt 41 through the registration roller pair 44 and the sheet introduction guide 23. The sheet S is conveyed by the conveying belt 41. The image forming unit 50 performs image forming processing on a second surface (rear surface) of the sheet S opposite to the first surface. The sheet S subjected to duplex printing passes through the second conveyance path 12 to be output from the sheet output port 12A onto the sheet output unit 14.

In most cases, the ink-jet image forming apparatus 1 uses water-based inks that contain moisture. When the paper sheet S absorbs water, hydrogen bonds of cellulose of the sheet S break and the sheet S swells. This causes the sheet S to curl (curve) in a manner that the side of the surface that has caught the ink (the face on which an image is formed) projects. The image forming apparatus 1 thus includes the decurling device 60 that decurls the sheet S.

[Configuration of Decurling Device]

Figure 2:
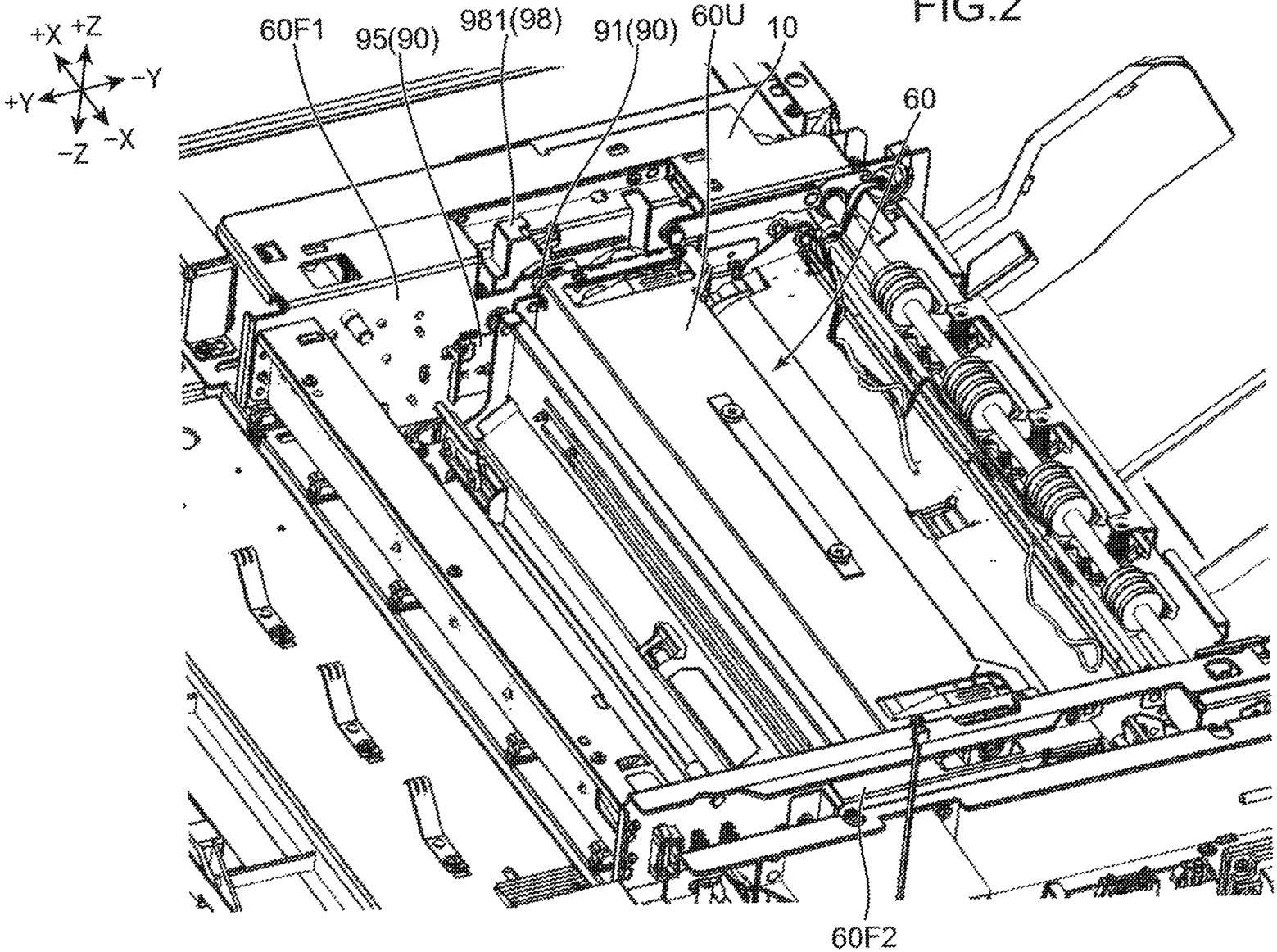
FIG. 2 is a perspective view of a vicinity of a decurling device included in the image forming apparatus.

FIG. 2 is a perspective view of a vicinity of the decurling device 60 included in the image forming apparatus 1. The decurling device 60 includes a first frame 60F1, a second frame 60F2, a decurling unit 60U, a level adjustment mechanism 90, and a fixing mechanism 98.

The first frame 60F1 and the second frame 60F2 are disposed so as to face each other with a predetermined interval in the X-axis direction and extend in the Y-axis direction. The first frame 60F1 and the second frame 60F2 partially constitute the apparatus body 10 of the image forming apparatus 1. The first frame 60F1 and the second frame 60F2 support the decurling unit 60U.

<Decurling Unit>

Figure 3:
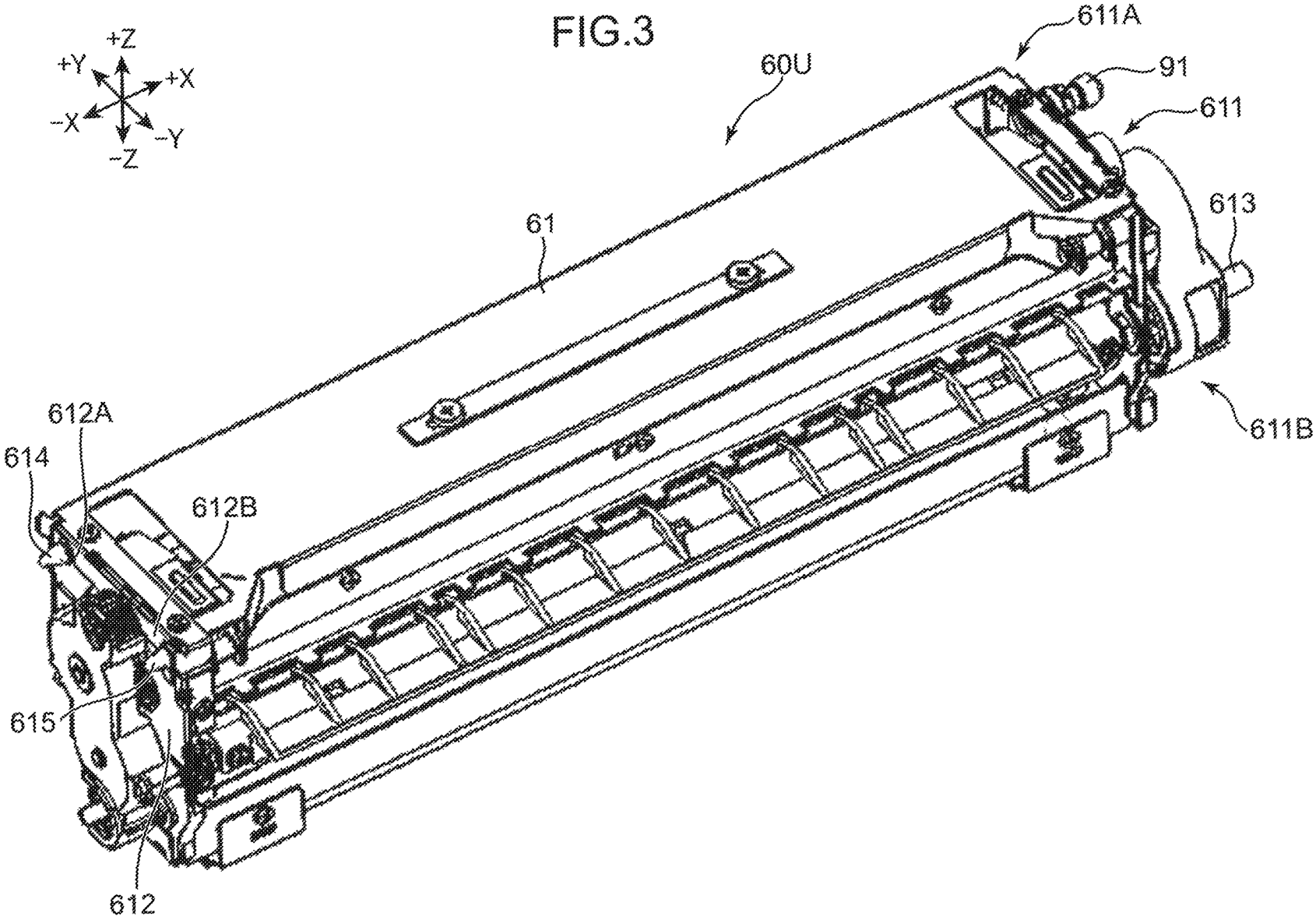
FIG. 3 is a perspective view of a decurling unit in the decurling device.
Figure 4:
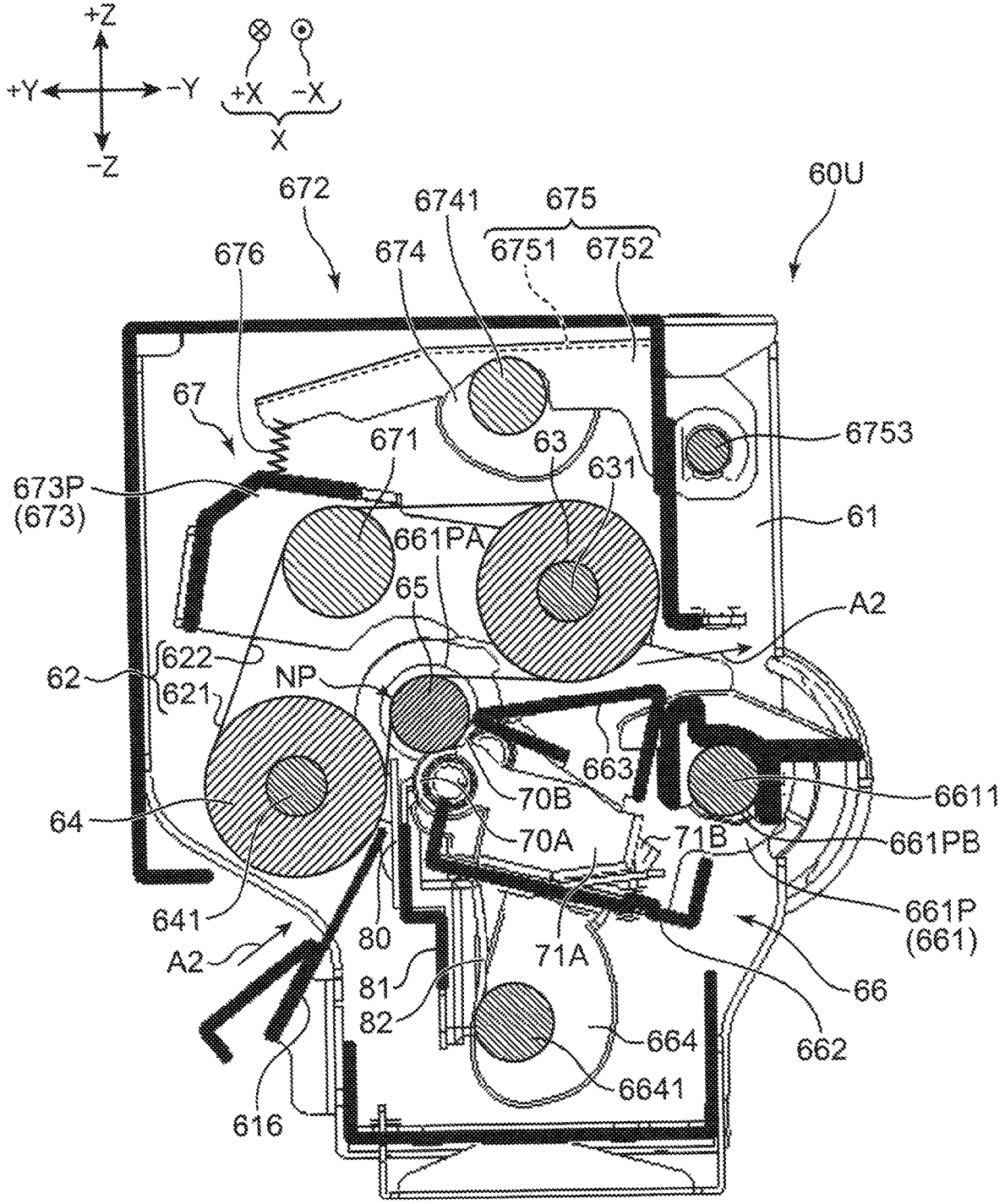
FIG. 4 is a cross-sectional view of the decurling unit.

FIG. 3 is a perspective view of the decurling unit 60U in the decurling device 60. FIG. 4 is a cross-sectional view of the decurling unit 60U. The decurling unit 60U is attached to the apparatus body 10 so as to be supported by the first frame 60F1 and the second frame 60F2. The decurling unit 60U decurls the sheet S having an image formed thereon. The decurling unit 60U includes a housing 61, a decurl belt 62, a first support roller 63 and a second support roller 64 that constitute a pair of support rollers, a decurling roller 65, a nip width adjustment mechanism 66, a belt tension adjustment mechanism 67, abutment members 70A, 70B, and a guide member 80.

The housing 61 is a box-shaped casing that houses various components constituting the decurling unit 60U. The housing 61 is disposed between the first frame 60F1 and the second frame 60F2 in the X-axis direction and between the sheet sending guide 45 and the second conveyance path 12 in the Y-axis direction. Referring to FIG. 3, the housing 61 includes a first sidewall 611 at one end portion (first end portion on +X side) in a longitudinal direction along the X-axis direction (first direction). The first sidewall 611 includes a first support part 611A and a second support part 611B that are spaced apart from each other in the Y-axis direction. In addition, the housing 61 also includes a second sidewall 612 at the other end portion (second end portion on −X side) in the longitudinal direction (first direction). The second sidewall 612 includes a third support part 612A and a fourth support part 612B that are spaced apart from each other in the Y-axis direction.

Referring to FIGS. 2 and 3, in the housing 61, the first support part 611A and the second support part 611B are supported by the first frame 60F1 at the one longitudinal end (end on +X side), and the third support part 612A and the fourth support part 612B are supported by the second frame 60F2 at the other longitudinal end (end on −X side). Specifically, the first support part 611A includes a first position adjustment unit 91 of the level adjustment mechanism 90 to be described later. The second support part 611B includes a support shaft 613 with transmission gears for transmitting drive force to rotationally drive the first support roller 63 to be described later. In addition, the third support part 612A includes a first support pin 614 and the fourth support part 612B includes a second support pin 615. The one longitudinal end portion of the housing 61 is supported by the first frame 60F1 at the first position adjustment unit 91 and the support shaft 613, and the other longitudinal end portion of the housing 61 is supported by the second frame 60F2 at the first support pin 614 and the second support pin 615.

As illustrated in FIG. 4, a sheet guide piece 616 is disposed at an end portion of the housing 61 on the +Y side and the −Z side. The sheet S that has been sent from the conveying belt 41 and guided by the sheet sending guide 45 is received at the sheet guide piece 616 by the decurling unit 60U. The sheet guide piece 616 guides the sheet S conveyed in a sheet conveyance direction A2 to the decurl belt 62.

The decurl belt 62 is an endless belt having a width in the X-axis direction. The decurl belt 62 is stretched on the first support roller 63 and the second support roller 64. The decurl belt 62 circulates according to the rotation of the first support roller 63 and the second support roller 64. As illustrated in FIG. 4, the first support roller 63 and the second support roller 64 are paired support rollers disposed in the housing 61 so as to be spaced apart from each other in the Y-axis direction and the Z-axis direction.

The first support roller 63 is a drive roller extending in the X-axis direction. The first support roller 63 has end portions rotatably supported by the first sidewall 611 and the second sidewall 612 that are longitudinal end portions of the housing 61. The first support roller 63 is rotationally driven about a rotating shaft 631 by drive force of a drive motor, the drive force being input through the transmission gears of the support shaft 613. This causes the decurl belt 62 to circulate. The second support roller 64 is a follower roller extending in the X-axis direction.

The second support roller 64 has end portions rotatably supported by the first sidewall 611 and the second sidewall 612 that are the longitudinal end portions of the housing 61. The second support roller 64 is rotated about a rotating shaft 641 following the circulation of the decurl belt 62. The second support roller 64 is disposed on the +Y side and the −Z side of the first support roller 63 so as to be adjacent to the sheet guide piece 616.

A conveyance region for conveying the sheet S is a region, on an outer circumferential surface 621 of the decurl belt 62, which faces the decurling roller 65 to be described later, and between the first support roller 63 and the second support roller 64. That is, the first support roller 63 defines a downstream end in the sheet conveyance direction A2 in the decurling unit 60U, and the second support roller 64 defines an upstream end in the sheet conveyance direction A2 in the decurling unit 60U.

As illustrated in FIG. 4, the decurling roller 65 extends in the X-axis direction. The decurling roller 65 is rotatably supported by a first roller support holder 661 in the nip width adjustment mechanism 66 to be described later. The decurling roller 65 press-contacts the outer circumferential surface 621 of the decurl belt 62 between the first support roller 63 and the second support roller 64, and is rotated following the circulation of the decurl belt 62.

A nip NP through which the sheet S passes is formed between the decurl belt 62 and the decurling roller 65. The nip NP is curved along the outer circumferential surface of the decurling roller 65. That is to say, the radius of curvature at the curved nip NP is equal to the radius of the decurling roller 65. The sheet S having an image formed thereon is conveyed in the sheet conveyance direction A2 by the decurl belt 62, which is circulating, passes through the nip NP having a curved shape, and thus is decurled.

The nip width adjustment mechanism 66 moves the decurling roller 65 in a direction of moving away from the decurl belt 62, that is, in a radial direction crossing the axial direction of the decurling roller 65 (X-axis direction) to change a nip width of the nip NP. The nip width of the nip NP is a width in a direction in which the sheet S passes (sheet conveyance direction A2), the direction being orthogonal to the axial direction of the decurling roller 65 (X-axis direction), and is a width along the outer circumferential surface of the decurling roller 65.

The nip width adjustment mechanism 66 moves the decurling roller 65 to change the nip width of the nip NP between a first nip width that is a reference nip width, a second nip width larger than the first nip width, and a third nip width smaller than the first nip width. In the decurling unit 60U, the nip width adjustment mechanism 66 is configured to change the nip width of the nip NP. It is thus possible to change decurling force on the sheet S passing through the nip NP.

The larger the nip width of the nip NP is, the larger the decurling force on the sheet S passing through the nip NP is. That is, as the nip width adjustment mechanism 66 moves the decurling roller 65, the decurling force on the sheet S passing through the nip NP in a case where the nip with of the nip NP is the second nip width is larger than the decurling force in a case where the nip width of the nip NP is the first nip width that is the reference nip width. On the other hand, as the nip width adjustment mechanism 66 moves the decurling roller 65, the decurling force on the sheet S passing through the nip NP in a case where the nip with of the nip NP is the third nip width is smaller than the decurling force in the case where the nip width of the nip NP is the first nip width that is the reference nip width.

The degree (curvature) of curling of the sheet S having an image formed thereon depends on the area ratio of the image formed on the sheet S. The larger the image area ratio is, the larger the degree of curling of the sheet S is. The degree of curling of the sheet S also depends on a sheet thickness. The larger the sheet thickness is, the smaller the degree of curling of the sheet S is. The degree of curling of a second sheet (thick paper) that is thicker than a first sheet (plain paper) having a reference sheet thickness is hardly affected by the image area ratio. On the other hand, the degree of curling of the first sheet is easily affected by the image area ratio.

In a case of the first sheet with a standard degree of curling, whose image area ratio is less than or equal to a predetermined image area ratio, the nip width of the nip NP is the first nip width that is the reference nip width. In a case of the first sheet with a larger degree of curling than the standard degree of curling, whose image area ratio exceeds the predetermined image area ratio, the nip width of the nip NP is changed to the second nip width larger than the first nip width that is the reference nip width. Consequently, when a sheet with a large degree of curling passes through the nip NP, larger decurling force can be applied to the sheet. The sheet curled at the time of image formation can thus be appropriately decurled.

On the other hand, in a case of the second sheet with a smaller degree of curling than the standard degree of curling, the nip width of the nip NP is changed to the third nip width smaller than the first nip width that is the reference nip width. Consequently, when a sheet that has a small degree of curling and is easily curled in the opposite direction to the direction at the time of image formation when receiving excessive decurling force, passes through the nip NP, smaller decurling force can be applied to the sheet. The sheet curled at the time of image formation can thus be appropriately decurled.

A specific configuration of the nip width adjustment mechanism 66 will be described below. The nip width adjustment mechanism 66 includes the first roller support holder 661 that rotatably supports the decurling roller 65 and a nip width adjustment cam 664.

The first roller support holder 661 includes paired first support plates 661P disposed to face each other with an interval in the width direction (X-axis direction) and a bottom plate 662 extending along the decurling roller 65. Each of the paired first support plates 661P is formed by bending ends of the bottom plate 662 in the X-axis direction to the +Z side so as to stand upright. Each of the paired first support plates 661P includes a bearing 661PA that rotatably supports the decurling roller 65. The first roller support holder 661 is supported in the housing 61 so as to be rotatable about a rotating shaft 6611 inserted in through-holes 661PB in the paired first support plates 661P.

The nip width adjustment cam 664 abuts against the bottom plate 662 in the first roller support holder 661. The nip width adjustment cam 664 abuts against widthwise end portions of the bottom plate 662.

A sheet guide 663 is disposed between the paired first support plates 661P so as to extend over an entire widthwise region. The sheet guide 663 is fixed to the paired first support plates 661P so as to face the first support roller 63 with the decurl belt 62 being interposed therebetween. The sheet guide 663 guides conveyance of the sheet S having passed through the nip NP by the circulation of the decurl belt 62.

The nip width adjustment cam 664 is a cam member that rotates about a cam rotating shaft 6641 while abutting against the bottom plate 662. The cam rotating shaft 6641 extends along the decurling roller 65 on the −Z side of the bottom plate 662. In the present embodiment, the nip width adjustment cam 664 is fixed to each of end portions of the cam rotating shaft 6641. The cam rotating shaft 6641 is rotatably supported in the housing 61. The nip width adjustment cam 664 causes the first roller support holder 661 to rotate about the rotating shaft 6611 so that the decurling roller 65 moves away from the decurl belt 62.

In the nip width adjustment mechanism 66, the first roller support holder 661 rotates about the rotating shaft 6611 according to the rotation of the nip width adjustment cam 664. When the first roller support holder 661 rotates, the decurling roller 65 supported by the first roller support holder 661 moves relative to the decurl belt 62. The nip width of the nip NP is thus changed. A movement trajectory of the decurling roller 65 according to the rotation of the first roller support holder 661 about the rotating shaft 6611 has an arc shape whose center is at the rotating shaft 6611.

Next, the belt tension adjustment mechanism 67 changes tension of the decurl belt 62 depending on the nip width changed by the nip width adjustment mechanism 66. As the tension of the decurl belt 62 is changed as described above, conveyance force applied to the sheet S when passing through the nip NP is kept constant even though the nip width changes. It is thus possible to achieve appropriate conveyance of the sheet S passing through the nip NP.

The belt tension adjustment mechanism 67 reduces the tension of the decurl belt 62 in proportion to the nip width of the nip NP in the present embodiment. More specifically, the belt tension adjustment mechanism 67 changes the tension of the decurl belt 62 so that first tension is less than second tension. The first tension corresponds to a state where the nip width of the nip NP is set to the first nip width, which is the reference nip width, by the nip width adjustment mechanism 66. The second tension corresponds to a state where the nip width of the nip NP is set to the second nip width that is larger than the first nip width.

Moreover, the belt tension adjustment mechanism 67 changes the tension of the decurl belt 62 so that third tension is larger than the first tension. The third tension corresponds to a state where the nip width of the nip NP is set to the third nip width that is smaller than the first nip width. As the belt tension adjustment mechanism 67 adjusts the tension of the decurl belt 62, conveyance force applied to the sheet S when passing through the nip NP is kept constant even though the nip width changes between the first nip width, the second nip width, and the third nip width. Consequently, it is possible to change decurling force on the sheet S depending on a change in the nip width while achieving appropriate conveyance of the sheet S passing through the nip NP.

A specific configuration of the belt tension adjustment mechanism 67 will be described below. The belt tension adjustment mechanism 67 includes a tension roller 671 and a roller movement mechanism 672.

The tension roller 671 is disposed on a side of the inner circumferential surface 622 of the decurl belt 62, and applies tension to the decurl belt 62 while supporting the decurl belt 62 to be circulable. The tension roller 671 extends in the X-axis direction and is rotatably supported by a second roller support holder 673 in the roller movement mechanism 672 to be described later. The tension roller 671 is rotated following by the circulation of the decurl belt 62.

The roller movement mechanism 672 moves the tension roller 671 in a direction crossing an axial direction of the tension roller 671 (X-axis direction) to change the tension of the decurl belt 62. The roller movement mechanism 672 moves the tension roller 671 without changing positions of the first support roller 63 and the second support roller 64 that support the decurl belt 62. As described above, the first support roller 63 defines the downstream end in the sheet conveyance direction A2 in the decurling unit 60U, and the second support roller 64 defines the upstream end in the sheet conveyance direction A2 in the decurling unit 60U. In moving the tension roller 671, the roller movement mechanism 672 does not change the positions of the first support roller 63 and the second support roller 64. The upstream end and downstream end in the sheet conveyance direction A2 can thus be fixed in the decurling unit 60U.

A specific configuration of the roller movement mechanism 672 will be described below. The roller movement mechanism 672 includes the second roller support holder 673 that supports the tension roller 671, a belt tension adjustment cam 674, a cam abutment member 675, and a coupling spring 676.

The second roller support holder 673 is constituted by paired second support plates 673P disposed to face each other with an interval in the width direction (X-axis direction). The tension roller 671 is supported between the paired second support plates 673P. The paired second support plates 673P constituting the second roller support holder 673 are disposed outside of the paired first support plates 661P constituting the first roller support holder 661 and outside of the first support roller 63 in the widthwise direction.

The second roller support holder 673 is supported in the housing 61 so as to be rotatable about a rotating shaft penetrating the paired second support plates 673P. The rotating shaft of the second roller support holder 673 is coaxial with the rotating shaft 631 of the first support roller 63.

In the roller movement mechanism 672, the belt tension adjustment cam 674 abuts against the cam abutment member 675. The cam abutment member 675 is supported in the housing 61 so as to be rotatable about a rotating shaft 6753 disposed on the +Z side of the second roller support holder 673. The cam abutment member 675 includes a cam abutment part 6751 that is formed in a plate shape and extends in the width direction and paired extending parts 6752 that extend from widthwise edges of the cam abutment part 6751 toward the −Z side. The belt tension adjustment cam 674 abuts against the cam abutment part 6751. The rotating shaft 6753 penetrates the paired extending parts 6752. Each of the paired extending parts 6752 is coupled to each of the paired second support plates 673P of the second roller support holder 673 by a coupling spring 676. That is, the cam abutment member 675 is coupled to the second roller support holder 673 by the coupling spring 676.

The belt tension adjustment cam 674 is a cam member that is supported in the housing 61 so as to be rotatable about a cam rotating shaft 6741. The belt tension adjustment cam 674 is disposed in a widthwise center part of the cam abutment part 6751 of the cam abutment member 675. Alternatively, paired belt tension adjustment cams 674 are disposed on widthwise both sides. The belt tension adjustment cam 674 rotates about the cam rotating shaft 6741 while abutting against the cam abutment part 6751 of the cam abutment member 675. In the roller movement mechanism 672, the cam abutment member 675 rotates about the rotating shaft 6753 according to the rotation of the belt tension adjustment cam 674. When the cam abutment member 675 rotates, the second roller support holder 673 that is coupled via the coupling spring 676 to the cam abutment member 675 rotates about a rotating shaft 6731. When the second roller support holder 673 rotates, the tension roller 671 supported by the second roller support holder 673 is moved. This changes the tension of the decurl belt 62.

Next, the guide member 80 that is included in the decurling unit 60U will be described. The guide member 80 is a plate-shaped member that is disposed between the paired first support plates 661P of the first roller support holder 661 so as to extend over an entire widthwise region. The guide member 80 guides the sheet S having been guided by the sheet guide piece 616 and supplied to the decurl belt 62 to the nip NP.

The guide member 80 is held by a guide holder 81. The guide holder 81 is hung from the decurling roller 65 at an end of each of the paired first support plates 661P on the +Y side so that the guide member 80 extending upright in the Z-axis direction faces the sheet guide piece 616. A slide member 82 is fixed to the guide holder 81. The slide member 82 slides in the Z-axis direction while abutting against the cam rotating shaft 6641 according to the rotation of the first roller support holder 661 due to the rotation of the nip width adjustment cam 664.

As the guide holder 81 is hung from the decurling roller 65, the guide holder 81 moves in the Z-axis direction while keeping its upright orientation according to the rotation of the first roller support holder 661. In this case, the slide member 82 slides in the Z-axis direction while abutting against the cam rotating shaft 6641, and thus the orientation of the guide holder 81 is kept upright during the rotation of the first roller support holder 661. The position and orientation of the guide member 80 held by the guide holder 81 are kept constant with respect to the decurling roller 65. It is thus possible to stably guide the sheet S to the nip NP by the guide member 80, and the sheet S can appropriately pass through the nip NP.

Next, abutment members 70A, 70B included in the decurling unit 60U will be described. The abutment members 70A, 70B are disposed in an axial center part of the decurling roller 65 so as to be opposite to the nip NP with the decurling roller 65 being provided therebetween. The abutment members 70A, 70B abut against the decurling roller 65 to prevent sagging of the decurling roller 65. In the present embodiment, the abutment members 70A, 70B are formed of rotating members that abut against the decurling roller 65 to be rotated following the rotation of the decurling roller 65.

When the decurling roller 65 is moved by the nip width adjustment mechanism 66 in order to change the nip width of the nip NP to the second nip width larger than the first nip width that is the reference nip width, a large nip load is generated in the nip NP. When the axial center part of the decurling roller 65 tends to sag in a direction away from the decurl belt 62 (direction opposite to nip NP) due to such a large nip load, the abutment members 70A, 70B formed of rotating members abut against the decurling roller 65 to be rotated following the rotation of the decurling roller 65. It is thus possible to prevent the decurling roller 65 from excessively sagging. Consequently, it is possible to prevent "wrinkles" on the sheet S passing through the nip NP. In addition, it is possible to prevent a variation in decurling force on the sheet S in the axial direction of the decurling roller 65. As a result, the sheet S can be appropriately decurled. The abutment members 70A, 70B formed of rotating members abut against the decurling roller 65 to be rotated following the rotation of the decurling roller 65, and thus high friction force between the abutment members 70A, 70B and the decurling roller 65 can be prevented as much as possible.

In the present embodiment, a plurality of the abutment members 70A, 70B are arranged in the axial direction of the decurling roller 65. Specifically, two abutment members 70A, 70B are arranged. The two abutment members 70A, 70B are spaced apart from each other in the circumferential direction and axial direction of the decurling roller 65. One abutment member 70A is supported by a first support member 71A to be rotated following the first support member 71A. The other abutment member 70B is supported by a second support member 71B to be rotated following the second support member 71B. The first support member 71A and the second support member 71B partially constitute the first roller support holder 661 and are independently attached to the bottom plate 662 of the first roller support holder 661.

As the first support member 71A and the second support member 71B partially constitute the first roller support holder 661 and are attached to the bottom plate 662, the first support member 71A and the second support member 71B can move together with the decurling roller 65 according to the rotation of the first roller support holder 661 about the rotating shaft 6611. Positions of the abutment member 70A supported by the first support member 71A and the abutment member 70B supported by the second support member 71B are kept constant with respect to the decurling roller 65. Consequently, if the decurling roller 65 tends to sag, the abutment members 70A, 70B abut against the decurling roller 65 to be rotated following the rotation of the decurling roller 65, so that excessive sagging of the decurling roller 65 can be prevented.

<Level Adjustment Mechanism>

Figure 5:
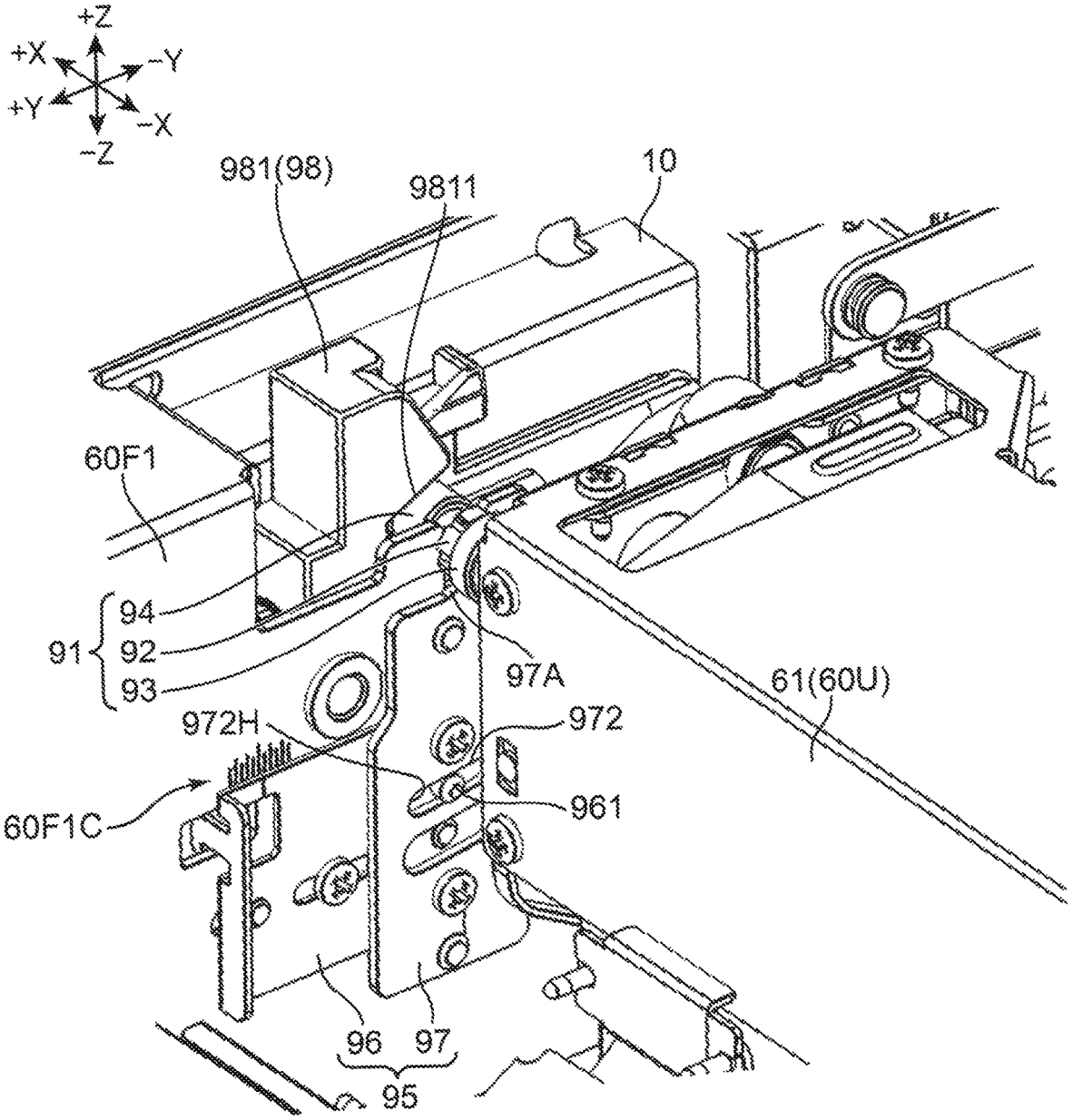
FIG. 5 is an enlarged perspective view of a vicinity of a level adjustment mechanism in the decurling device.

Next, the level adjustment mechanism 90 included in the decurling device 60 will be described with reference to FIG. 5 in addition to FIGS. 2 and 3. FIG. 5 is an enlarged perspective view of a vicinity of the level adjustment mechanism 90 in the decurling device 60.

As described above, in the decurling unit 60U, one end portion of the housing 61 in a longitudinal direction along the X-axis direction is supported by the first frame 60F1 at the first support part 611A and the second support part 611B, and the other end portion of the housing 61 in the longitudinal direction is supported by the second frame 60F2 at the third support part 612A and the fourth support part 612B.

The level adjustment mechanism 90 is used to adjust an inclination of the decurling unit 60U to the Z-axis direction (vertical direction) with respect to the X-axis direction, when the housing 61 is supported by the first frame 60F1 and the second frame 60F2. When adjusting the inclination of the decurling unit 60U, the level adjustment mechanism 90 adjusts, in the Z-axis direction, a position of one of the first support part 611A, the second support part 611B, the third support part 612A, and the fourth support part 612B in the housing 61 so that the first support roller 63 and the second support roller 64 extend along the X-axis direction. The first support roller 63 and the second support roller 64 are parallel to each other and thus it is possible to prevent the decurl belt 62 stretched on the first support roller 63 and the second support roller 64 from zigzagging. Damages of the decurl belt 62 and strange noises due to zigzagging of the decurl belt 62 can be prevented as much as possible. In addition, the sheet S passing through the nip NP formed on the decurl belt 62 can be appropriately decurled. In the present embodiment, the level adjustment mechanism 90 is configured to adjust, in the Z-axis direction, the position of the first support part 611A with respect to the second support part 611B, the third support part 612A, and the fourth support part 612B in the housing 61.

The level adjustment mechanism 90 includes the first position adjustment unit 91 and a second position adjustment unit 95. The first position adjustment unit 91 and the second position adjustment unit 95 are components for adjusting, in the Z-axis direction, the position of the first support part 611A in the housing 61. The first position adjustment unit 91 is disposed in the first support part 611A of the housing 61. The second position adjustment unit 95 is disposed in the first frame 60F1.

As described above, the one end portion of the housing 61 is supported by the first frame 60F1 at the first position adjustment unit 91 disposed in the first support part 611A and the support shaft 613 disposed in the second support part 611B. In addition, the other end portion of the housing 61 is supported by the second frame 60F2 at the first support pin 614 disposed in the third support part 612A and the second support pin 615 disposed in the fourth support part 612B.

The first support part 611A is supported by the first frame 60F1 by a cam member 92 of the first position adjustment unit 91 abutting against an abutment target 97A, which will be described in detail later. In this case, a body 942 of a fixing pin 94 of the first position adjustment unit 91 is inserted in a first cutaway part 60F1A of the first frame 60F1. The first cutaway part 60F1A has a margin with respect to the body 942 in the Y-axis direction and the Z-axis direction. That is, when the first position adjustment unit 91 adjusts the position in the Z-axis direction, the first support part 611A of the housing 61 is supported through the first position adjustment unit 91 by the first frame 60F1 so as to be capable of being displaced in the Y-axis direction and the Z-axis direction.

The second support part 611B is supported by the first frame 60F1 by the support shaft 613 being inserted in a positioning hole in the first frame 60F1. The positioning hole does not have a margin with respect to the support shaft 613 in the Y-axis direction and the Z-axis direction. That is, the second support part 611B of the housing 61 is supported through the support shaft 613 by the first frame 60F1 while displacement of the second support part 611B is restricted in the Y-axis direction and the Z-axis direction.

The third support part 612A is supported by the second frame 60F2 by the first support pin 614 being inserted in a support hole in the second frame 60F2. The support hole is an elongated hole extending in the Y-axis direction, and has a margin with respect to the first support pin 614 not in the Z-axis direction but in the Y-axis direction. That is, the third support part 612A of the housing 61 is supported through the first support pin 614 by the second frame 60F2 while displacement of the third support part 612A is allowed in the Y-axis direction but restricted in the Z-axis direction.

The fourth support part 612B is supported by the second frame 60F2 by the second support pin 615 being inserted in a positioning hole in the second frame 60F2. The positioning hole does not have a margin with respect to the second support pin 615 in the Y-axis direction and the Z-axis direction. That is, the fourth support part 612B of the housing 61 is supported through the second support pin 615 by the second frame 60F2 while displacement of the fourth support part 612B is restricted in the Y-axis direction and the Z-axis direction.

Since the first to fourth support parts 611A, 611B, 612A, and 612B are supported by the frames 60F1, 60F2 in the housing 61 as described above, the housing 61 is distorted not due to mispositioning in the Y-axis direction but due to mispositioning in the Z-axis direction. If the housing 61 is distorted, the first support roller 63 and the second support roller 64 are arranged in a distorted manner, which leads to zigzagging of the decurl belt 62. That is, to prevent distortion of the housing 61 that causes zigzagging of the decurl belt 62, it is necessary to adjust, in the Z-axis direction, the position of the first support part 611A by at least one of the first position adjustment unit 91 and the second position adjustment unit 95.

(First Position Adjustment Unit)

Figure 6:
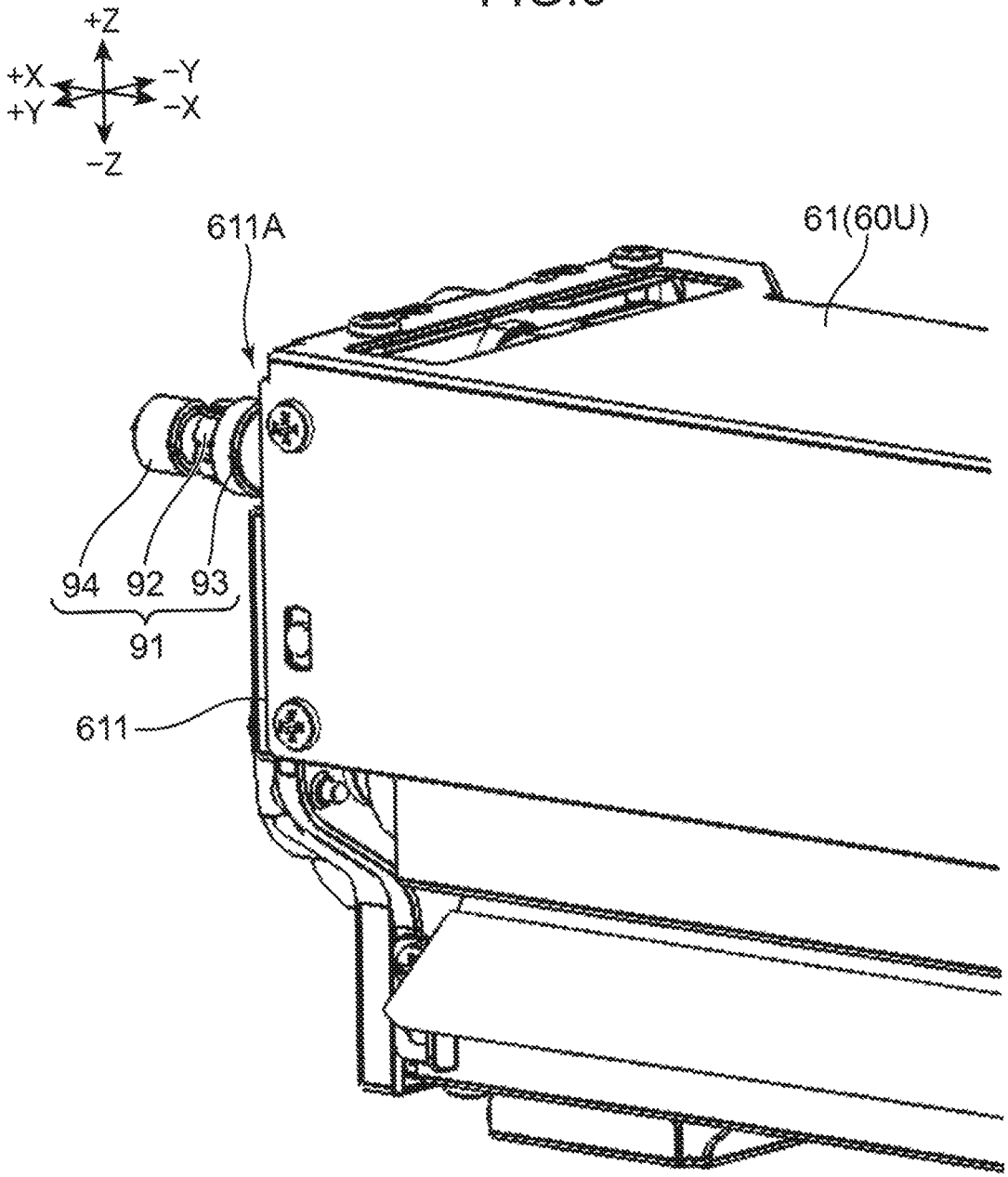
FIG. 6 is a perspective view illustrating a first position adjustment unit of the level adjustment mechanism attached to a housing of the decurling unit.
Figure 7:
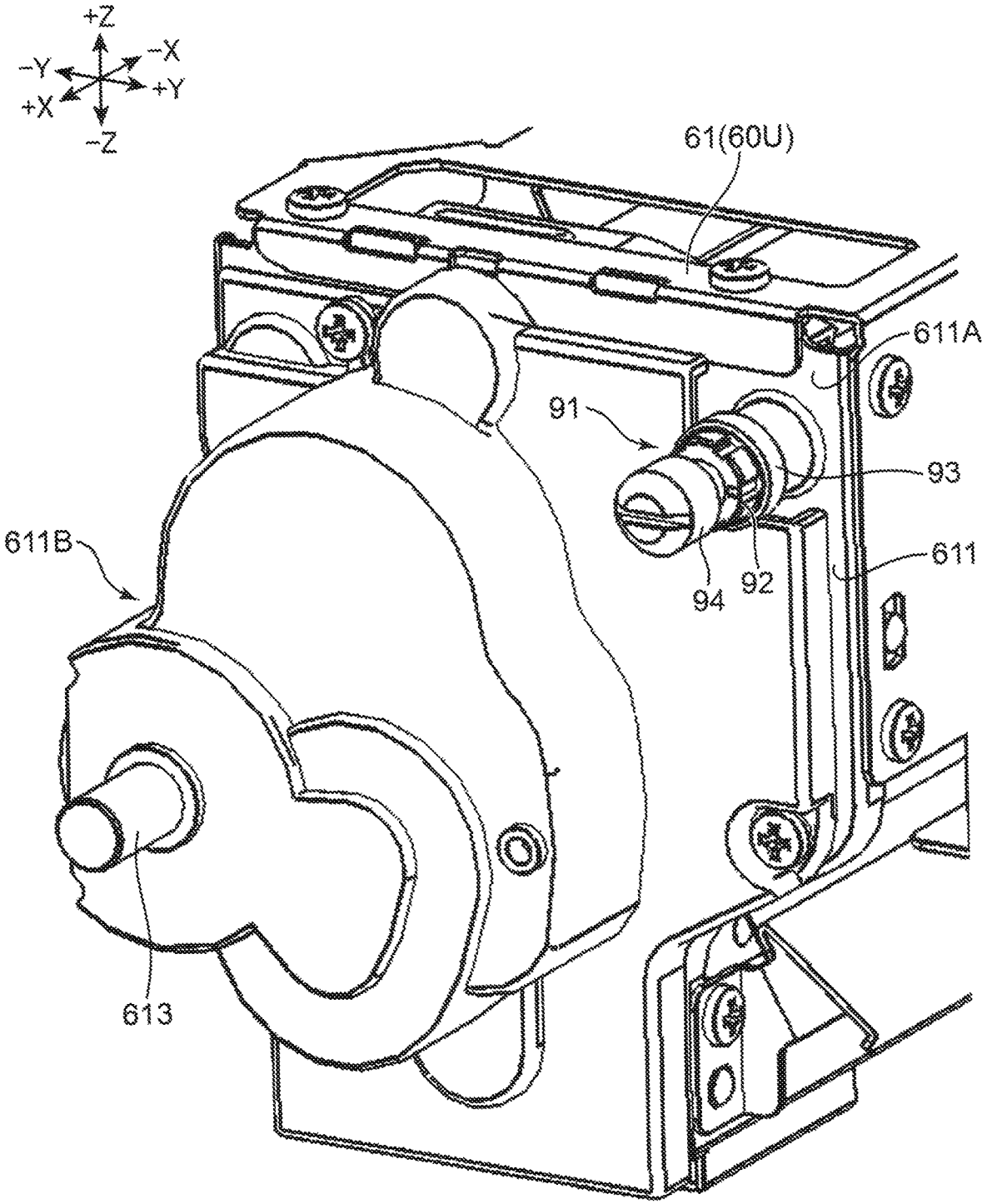
FIG. 7 is a perspective view illustrating the first position adjustment unit of the level adjustment mechanism attached to the housing of the decurling unit.
Figure 8:
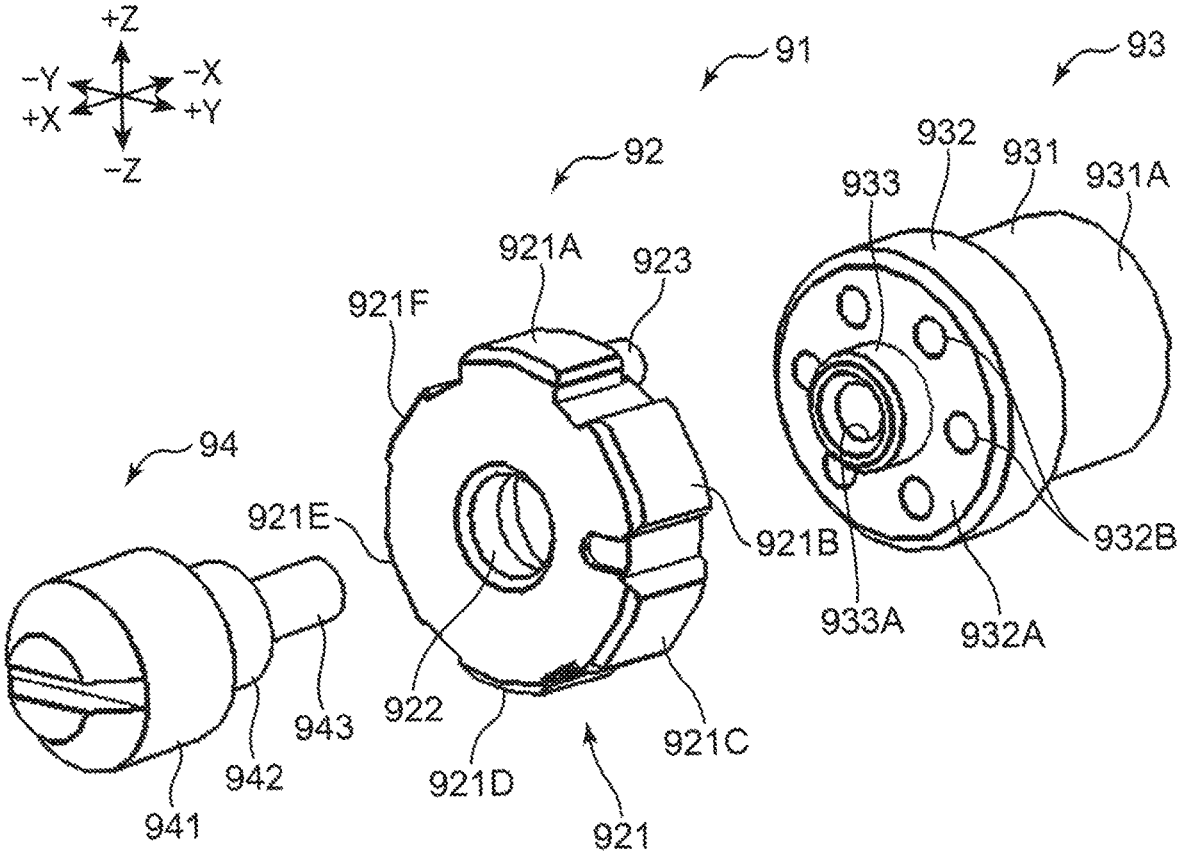
FIG. 8 is an exploded perspective view of the first position adjustment unit.
Figure 9:
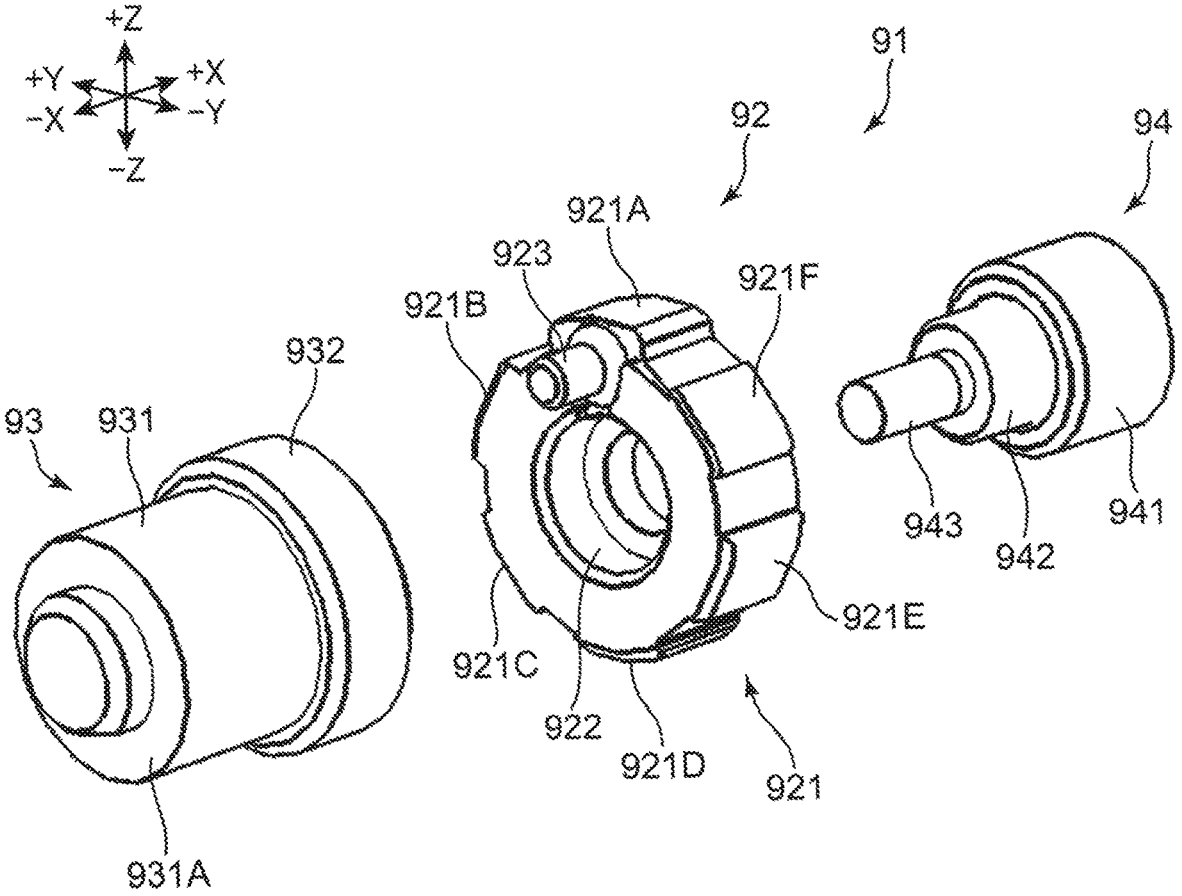
FIG. 9 is an exploded perspective view of the first position adjustment unit.
Figure 10:
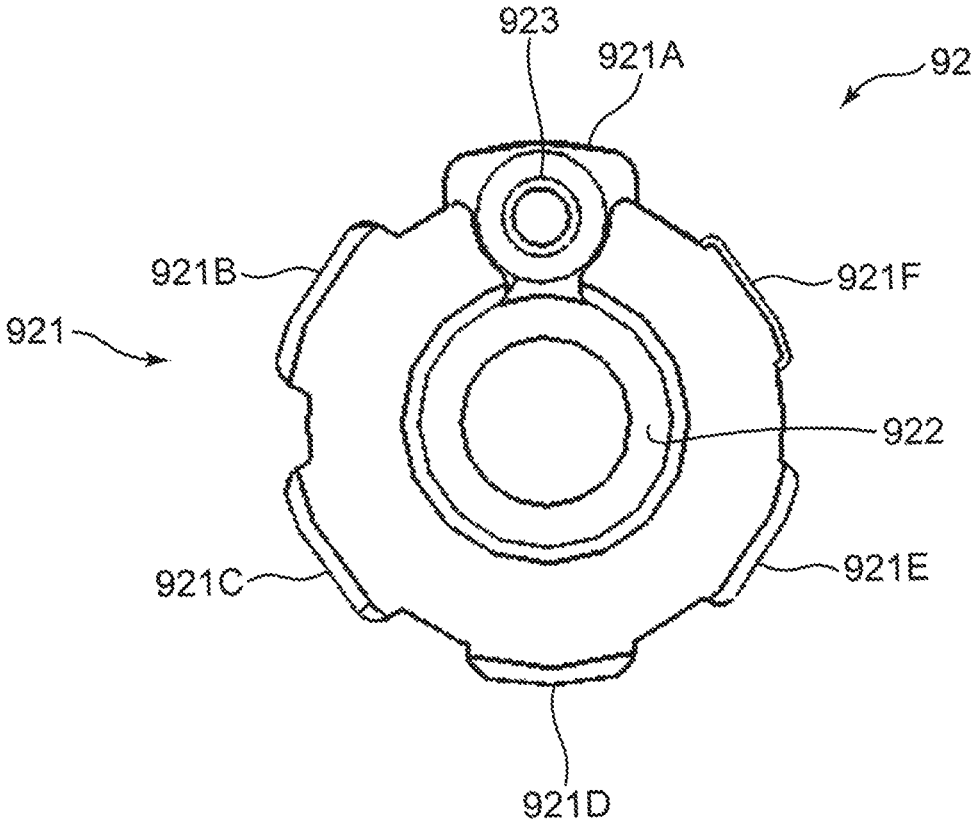
FIG. 10 is a front view of a cam member of the first position adjustment unit.
Figure 11A:
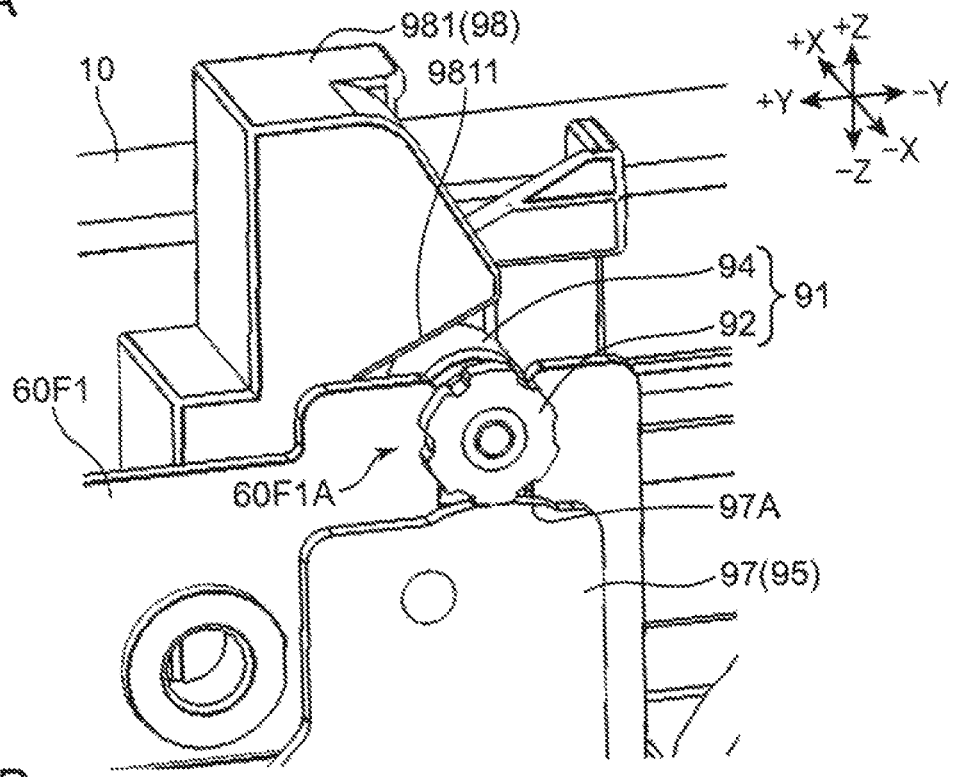
FIGS. 11A and 11B are perspective views illustrating a positional relationship between the first position adjustment unit and a first frame.
Figure 11B:
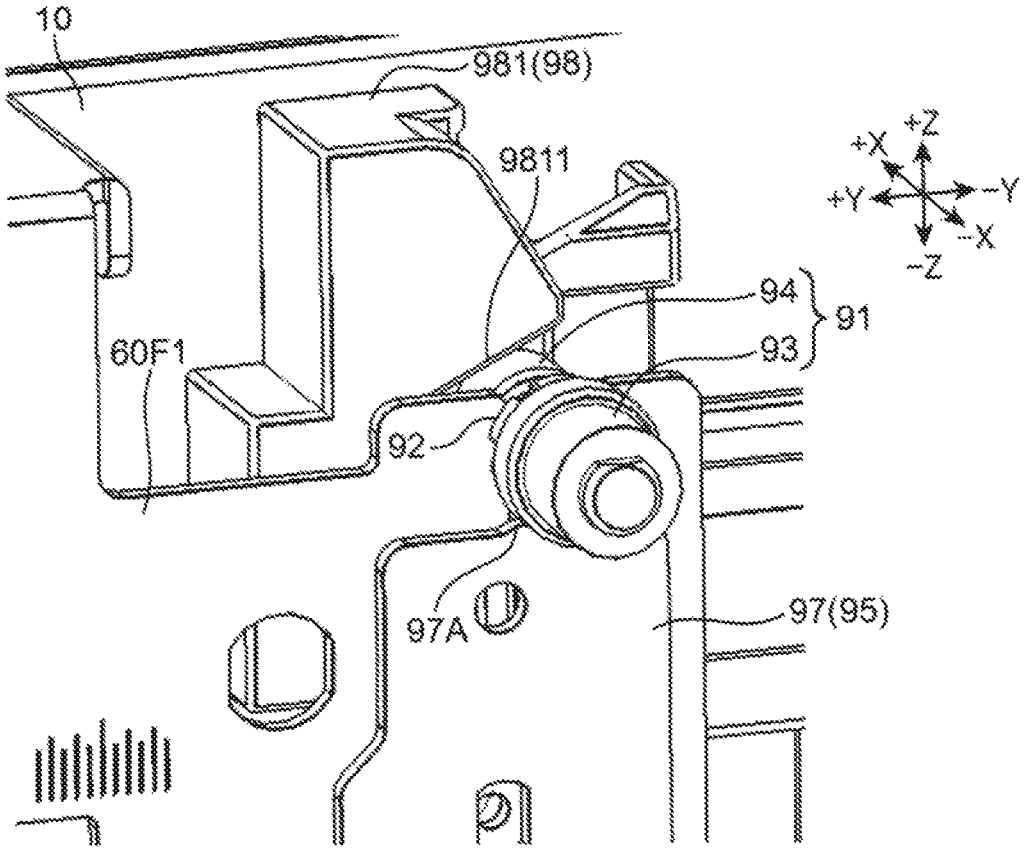

The first position adjustment unit 91 of the level adjustment mechanism 90 will be described with reference to FIGS. 6 to 11 in addition to FIG. 5. FIGS. 6 and 7 are perspective views illustrating the first position adjustment unit 91 attached to the housing 61 of the decurling unit 60U. FIGS. 8 and 9 are exploded perspective views of the first position adjustment unit 91. FIG. 10 is a front view of the cam member 92 of the first position adjustment unit 91. FIGS. 11A and 11B are perspective views illustrating a positional relationship between the first position adjustment unit 91 and the first frame 60F1. The first position adjustment unit 91 includes the cam member 92, a holder 93, and the fixing pin 94. In the first position adjustment unit 91, the fixing pin 94, the cam member 92, and the holder 93 are arranged in this order from the +X side to the −X side in the X-axis direction (see FIGS. 6 and 7). That is, the cam member 92 is sandwiched between the holder 93 and the fixing pin 94 in the first position adjustment unit 91.

The cam member 92 includes a cam surface 921 that abuts against the predetermined abutment target 97A formed in the first frame 60F1 (see FIGS. 8 to 10). In the present embodiment, the abutment target 97A is formed in a second plate 97 of the second position adjustment unit 95 described later disposed in the first frame 60F1 (see FIGS. 5, 11A, and 11B). The cam surface 921 is divided into a plurality of cam regions 921A, 921B, 921C, 921D, 921E, 921F with different radii. These cam regions are arranged at predetermined equal intervals in a circumferential direction. In examples of FIGS. 8 to 10, the cam surface 921 is divided into six cam regions 921A, 921B, 921C, 921D, 921E, 921F, and the radii of the cam regions change stepwise in one circumferential direction.

The cam member 92 also includes a through-hole 922 that has a circular shape and is formed in a center part that is the center of the radius of the cam surface 921 and a projection 923 that has a cylindrical shape and projects from a side surface of the cam member 92 on a side on which the holder 93 is disposed (−X side).

The holder 93 projects from the first support part 611A of the housing 61 to the first frame 60F1, thus holding the cam member 92. As illustrated in FIGS. 8 and 9, the holder 93 includes a base 931 having a cylindrical shape, a flange 932, and a boss 933.

One end portion 931A of the base 931 is fixed to the first support part 611A of the housing 61. The flange 932 is formed at the other end portion of the base 931 to extend externally from an outer circumferential surface of the base 931. The flange 932 includes a plurality of fitting recesses 932B into which the projection 923 of the cam member 92 can fit in opposing surface 932A of cam member 92. The number of the fitting recesses 932B is equal to the number of the cam regions on the cam surface 921 of the cam member 92. That is, as the cam surface 921 is divided into the six cam regions 921A, 921B, 921C, 921D, 921E, 921F, six fitting recesses 932B are formed in an oppose surface 932A of the flange 932 at equal intervals in the circumferential direction. The boss 933 is a cylindrical part formed on the oppose surface 932A of the flange 932. An internal thread is formed on an inner circumferential surface 933A of the boss 933. The one end portion 931A of the base 931 is fixed to the first support part 611A of the housing 61, the projection 923 of the cam member 92 is fitted into one of the fitting recesses 932B in the flange 932, and the boss 933 is inserted in the through-hole 922 in the cam member 92. In this way, the holder 93 holds the cam member 92.

The fixing pin 94 is attached to the holder 93 so as to sandwich the cam member 92 between the fixing pin 94 and the holder 93, thus fixing the cam member 92 to the holder 93. As illustrated in FIGS. 8 and 9, the fixing pin 94 includes a head 941, a screw 943 with an outer thread, and the body 942 that is interposed between the head 941 and the screw 943 and couples the head 941 to the screw 943. In a state where the boss 933 is inserted in the through-hole 922 and the cam member 92 is held by the holder 93, the outer thread formed on the screw 943 is threaded into the internal thread formed on the inner circumferential surface 933A of boss 933. In this way, the fixing pin 94 is attached to the holder 93. In a state where the fixing pin 94 is attached to the holder 93, the body 942 of the fixing pin 94 presses the cam member 92 to the holder 93. Consequently, the fixing pin 94 fixes the cam member 92 to the holder 93.

As described above, the first position adjustment unit 91 is disposed in the first support part 611A of the housing 61. In the first position adjustment unit 91, the cam region of the cam surface 921 that abuts against the abutment target 97A formed in the second plate 97 of the second position adjustment unit 95 to be described later is determined by the position of the fitting recess 932B into which the projection 923 of the cam member 92 fits. As the cam region that abuts against the abutment target 97A changes between the cam regions 921A, 921B, 921C, 921D, 921E, 921F on the cam surface 921, the cam member 92 can adjust, in the Z-axis direction, the position of the first support part 611A in the housing 61. When the cam region on the cam surface 921, the cam region abutting against the abutment target 97A, is changed, the position of the first support part 611A in the housing 61 is adjusted in the Z-axis direction so that the first support roller 63 and the second support roller 64 extend along the X-axis direction. The first support roller 63 and the second support roller 64 are parallel to each other and thus it is possible to prevent the decurl belt 62 entrained around the first support roller 63 and the second support roller 64 from zigzagging.

An operator performs an operation of adjusting, in the Z-axis direction, the position of the first support part 611A in the housing 61 by using the first position adjustment unit 91. The operator uses a predetermined dedicated jig to check whether the decurl belt 62 zigzags. When the decurl belt 62 zigzags, the operator switches the fitting recess 932B into which the projection 923 of the cam member 92 fits. With this switching, the cam region on the cam surface 921 of the cam member 92, the cam region abutting against the abutment target 97A, can be changed. Consequently, it is possible to adjust, in the Z-axis direction, the position of the first support part 611A in the housing 61.

(Second Position Adjustment Unit)

Figure 12:
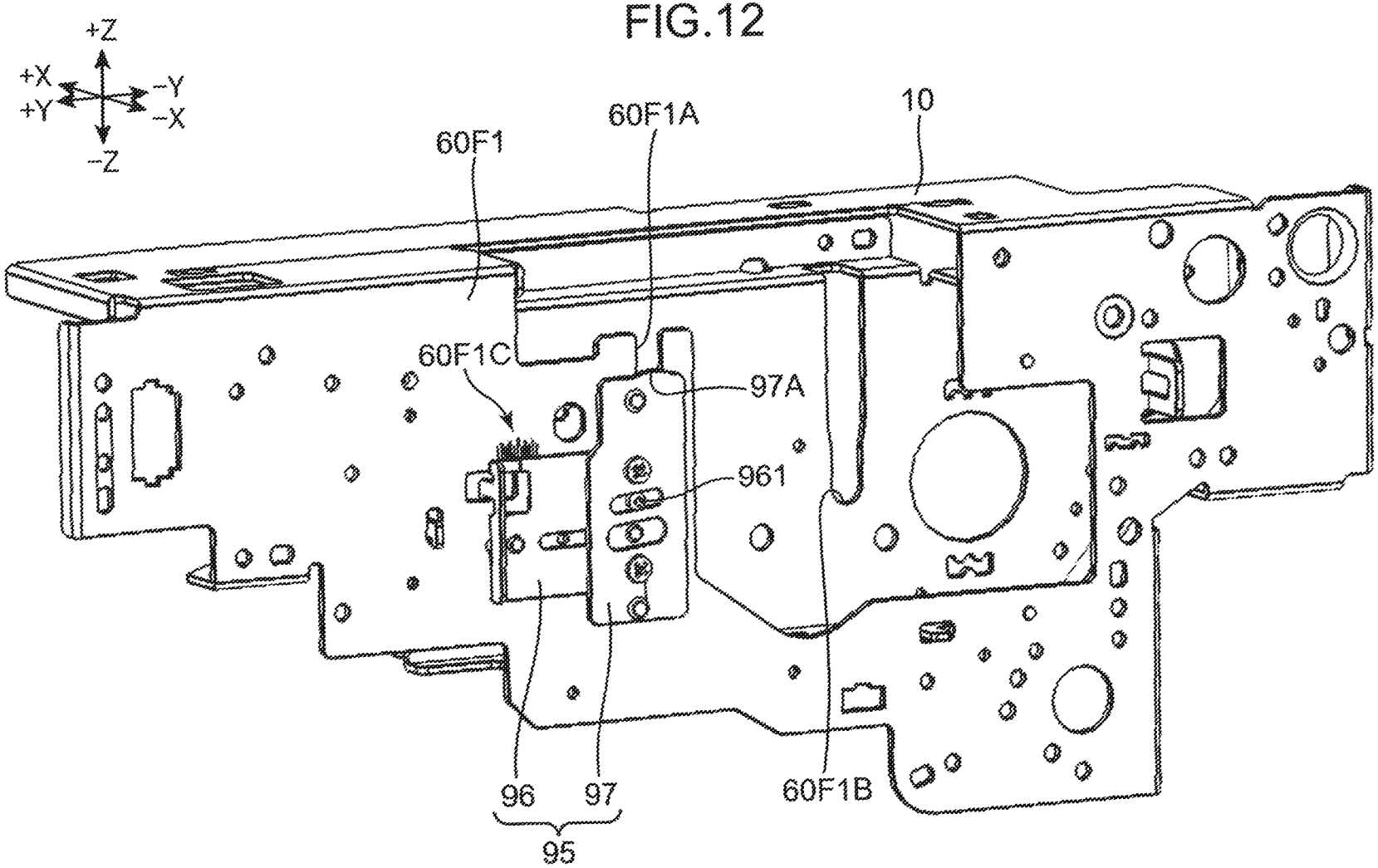
FIG. 12 is a perspective view illustrating a second position adjustment unit of the level adjustment mechanism attached to the first frame.
Figure 13:
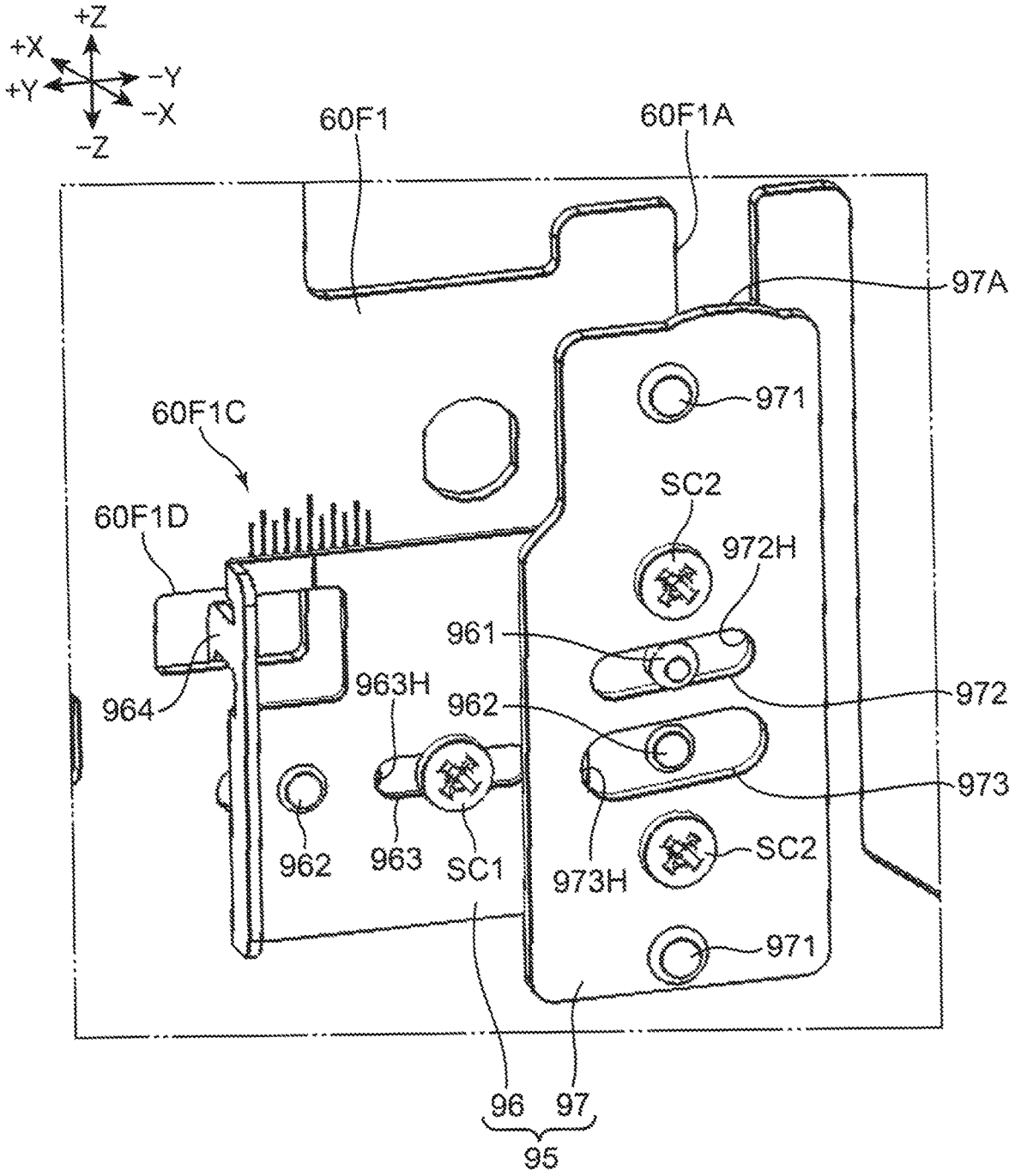
FIG. 13 is an enlarged perspective view of the second position adjustment unit.
Figure 14:
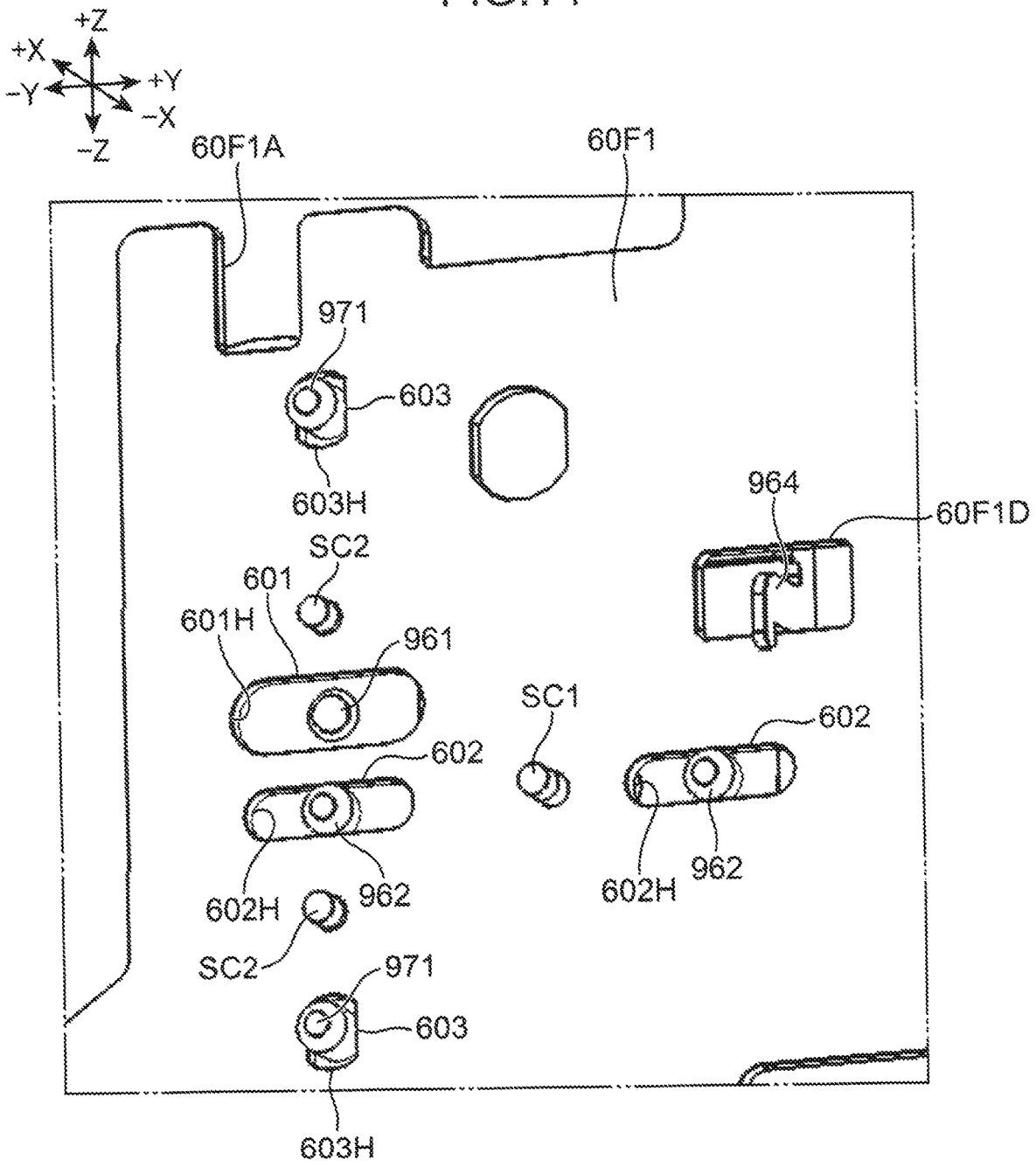
FIG. 14 is a perspective view of the second position adjustment unit attached to the first frame.

The second position adjustment unit 95 of the level adjustment mechanism 90 will be described with reference to FIGS. 12 to 14 in addition to FIG. 5. FIG. 12 is a perspective view illustrating the second position adjustment unit 95 of the level adjustment mechanism attached to the first frame 60F1. FIG. 13 is an enlarged perspective view of the second position adjustment unit 95. FIG. 14 is a perspective view of the second position adjustment unit 95 attached to the first frame 60F1. The second position adjustment unit 95 includes a first plate 96 and a second plate 97.

The second position adjustment unit 95 adjusts a position of the first support part 611A of the housing 61 in the vertical direction by shifting a position of the second plate 97 in the vertical direction. The first frame 60F1 on which the second position adjustment unit 95 is disposed includes a first cutaway part 60F1A and a second cutaway part 60F1B that are cut away from an edge on the +Z side to the −Z side, and a scale part 60F1C formed near the first cutaway part 60F1A, as illustrated in FIG. 12. As illustrated in FIGS. 11A and 11B, the body 942 of the fixing pin 94 of the first position adjustment unit 91 disposed in the first support part 611A of the housing 61 is inserted in the first cutaway part 60F1A. In such a state, the first support part 611A of the housing 61 is supported through the first position adjustment unit 91 by the first frame 60F1. The support shaft 613 (see FIGS. 3 and 7) disposed in the second support part 611B of the housing 61 is inserted in the second cutaway part 60F1B. In such a state, the second support part 611B of the housing 61 is supported through the support shaft 613 by the first frame 60F1. The scale part 60F1C indicates a movement amount of the first plate 96 of the second position adjustment unit 95 in the Y-axis direction, which will be described in detail later.

The first plate 96 is a substantially rectangular plate that is attached to the first frame 60F1 so as to be movable in the Y-axis direction. The first plate 96 is attached to the first frame 60F1 on the −Z side of the scale part 60F1C (see FIG. 13). The first plate 96 includes a first projecting pin 961, a second projecting pin 962, a hole end edge 963 defining a positioning hole 963H, and an engagement part 964.

The first projecting pin 961 projects from a side surface of the first plate 96 on the −X side to the −X side toward the second frame 60F2 to be inserted in an insertion hole 972H in the second plate 97 to be described later. The first frame 60F1 includes a hole end edge 601 that defines a pin interference prevention hole 601H for preventing interference of the first projecting pin 961 (see FIG. 14). The hole end edge 601 extends in the Y-axis direction so that the pin interference prevention hole 601H is an elongated hole extending in the Y-axis direction.

The second projecting pin 962 projects from a side surface of the first plate 96 on the +X side to the +X side toward the first frame 60F1. In an example of FIG. 13, two second projecting pins 962 are disposed in the first plate 96 with an interval in the Y-axis direction. The second projecting pin 962 is inserted in a first pin guide hole 602H formed in the first frame 60F1 (see FIG. 14). The first pin guide hole 602H is an elongated hole that is defined by a hole end edge 602 extending in the Y-axis direction and extends in the Y-axis direction.

The hole end edge 963 defining the positioning hole 963H extends in the Y-axis direction so that the positioning hole 963H is an elongated hole extending in the Y-axis direction. When the first plate 96 is positioned and fixed to the first frame 60F1 after the position of the first support part 611A of the housing 61 is adjusted by the second position adjustment unit 95 in the Z-axis direction, a screw SC1 is inserted in the positioning hole 963H.

The engagement part 964 is formed by bending an end portion of the first plate 96 on the +Y side to the −X side. The engagement part 964 engages with an engagement opening 60F1D formed in the first frame 60F1. The engagement opening 60F1D in the first frame 60F1 is an elongated hole that extends in the Y-axis direction to enable the engagement part 964 to engage therewith.

In the first plate 96 with the configuration described above, when the first projecting pin 961 is inserted in the insertion hole 972H of the second plate 97, the second projecting pin 962 is inserted in the first pin guide hole 602H and the engagement part 964 engages the engagement opening 60F1D. Consequently, the first plate 96 is attached to the first frame 60F1 so as to be movable in the Y-axis direction. When the first plate 96 is moved in the Y-axis direction, the amount of such movement being indicated by the scale part 60F1C, the second projecting pin 962 is moved along the first pin guide hole 602H and the engagement part 964 is moved along the engagement opening 60F1D.

The second plate 97 is a substantially rectangular plate that is supported by the first plate 96 at first projecting pin 961 so as to be movable in the Z-axis direction. The second plate 97 is disposed so as to face the first cutaway part 60F1A in the first frame 60F1 (see FIG. 13). The second plate 97 includes the abutment target 97A, a third projecting pin 971, a hole end edge 972 defining the insertion hole 972H, and a hole end edge 973 defining a pin interference prevention hole 973H.

The abutment target 97A is formed at an end edge (upper edge) of the second plate 97 on the +Z side. The cam surface 921 of the cam member 92 in the first position adjustment unit 91, the body 942 of the fixing pin 94 being inserted in the first cutaway part 60F1A, abuts against the abutment target 97A.

The third projecting pin 971 projects to the +X side toward the first frame 60F1 in a region on the second plate 97 that does not overlap the first plate 96 as viewed from the X-axis direction. In the example of FIG. 13, two third projecting pins 971 are disposed in the second plate 97 with an interval in the Z-axis direction. The third projecting pin 971 is inserted in a second pin guide hole 603H formed in the first frame 60F1 (see FIG. 14). The second pin guide hole 603H is an elongated hole that is defined by a hole end edge 603 extending in the Z-axis direction and extends in the Z-axis direction.

The hole end edge 972 defining the insertion hole 972H extends in the Y-axis direction so as to be inclined to the Z-axis direction with respect to the Y-axis direction. That is, the insertion hole 972H defined by the hole end edge 972 of the second plate 97 is an elongated hole that extends to be inclined to the Z-axis direction with respect to the Y-axis direction. As illustrated in FIG. 13, the hole end edge 972 defining the insertion hole 972H is inclined upward from the +Y side to the −Y side so that an end edge on the −Y side is closer to the +Z side than an end edge on the +Y side in the present embodiment. The first projecting pin 961 of the first plate 96 is inserted in the insertion hole 972H defined by the hole end edge 972 of the second plate 97.

The hole end edge 973 defining the pin interference prevention hole 973H extends in the Y-axis direction so as to be inclined to the Z-axis direction with respect to the Y-axis direction, like the hole end edge 972 defining the insertion hole 972H. The pin interference prevention hole 973H is disposed on the −Z side of the insertion hole 972H and prevents the second plate 97 from interfering with the second projecting pin 962 of the first plate 96.

While not illustrated in FIG. 13, the second plate 97 includes an elongated positioning hole extending in the Z-axis direction at a predetermined position on the +Z side of the insertion hole 972H and at a predetermined position on the −Z side of the pin interference prevention hole 973H. When the second plate 97 is positioned and fixed to the first frame 60F1 after the position of the first support part 611A of the housing 61 is adjusted by the second position adjustment unit 95 in the Z-axis direction, a screw SC2 is inserted in each of the positioning holes.

According to the second plate 97 with the configuration described above, the first plate 96 is moved in the Y-axis direction while the first projecting pin 961 of the first plate 96 is inserted in the insertion hole 972H. When the first plate 96 is moved in the Y-axis direction, movement force of the first projecting pin 961 due to the movement of the first plate 96 acts upon the hole end edge 972 defining the insertion hole 972H. As the hole end edge 972 of the insertion hole 972H is inclined to the Z-axis direction with respect to the Y-axis direction, the second plate 97 is moved in the Z-axis direction by the force that the first projecting pin 961 acts upon the hole end edge 972. When the second plate 97 is moved in the Z-axis direction, the third projecting pin 971 is moved along the second pin guide hole 603H. An inclination angle of the hole end edge 972 defining the insertion hole 972H with respect to the Y-axis direction is set such that the movement amount of the second plate 97 in the Z-axis direction is equal to the movement amount of the first plate 96 in the Y-axis direction.

An operator performs an operation of moving the first plate 96 in the Y-axis direction in order to move the second plate 97 in the Z-axis direction. The operator uses a predetermined dedicated jig to check the inclination of the first frame 60F1, move the first plate 96 based on the inclination of the first frame 60F1 while checking the scale part 60F1C, and adjust, in the Z-axis direction, the position of the abutment target 97A formed in the second plate 97.

As described above, the second position adjustment unit 95 configured to move the second plate 97 in the Z-axis direction by moving the first plate 96 in the Y-axis direction to shift the abutment target 97A in the Z-axis direction (vertical direction). This shifting operation moves the cam member 92 including the cam surface 921 against which the abutment target 97A abuts in the Z-axis direction. Consequently, the second plate 97 can adjust, in the Z-axis direction, the position of the first support part 611A of the housing 61, the first support part 611A including the first position adjustment unit 91 having the cam member 92 as a component. In moving the second plate 97 in the Z-axis direction according to the movement of the first plate 96 in the Y-axis direction, the position of the first support part 611A in the housing 61 is adjusted in the Z-axis direction so that the first support roller 63 and the second support roller 64 extend along the X-axis direction. The first support roller 63 and the second support roller 64 are parallel to each other and thus it is possible to prevent the decurl belt 62 entrained around the first support roller 63 and the second support roller 64 from zigzagging.

<Fixing Mechanism>

Figure 15:
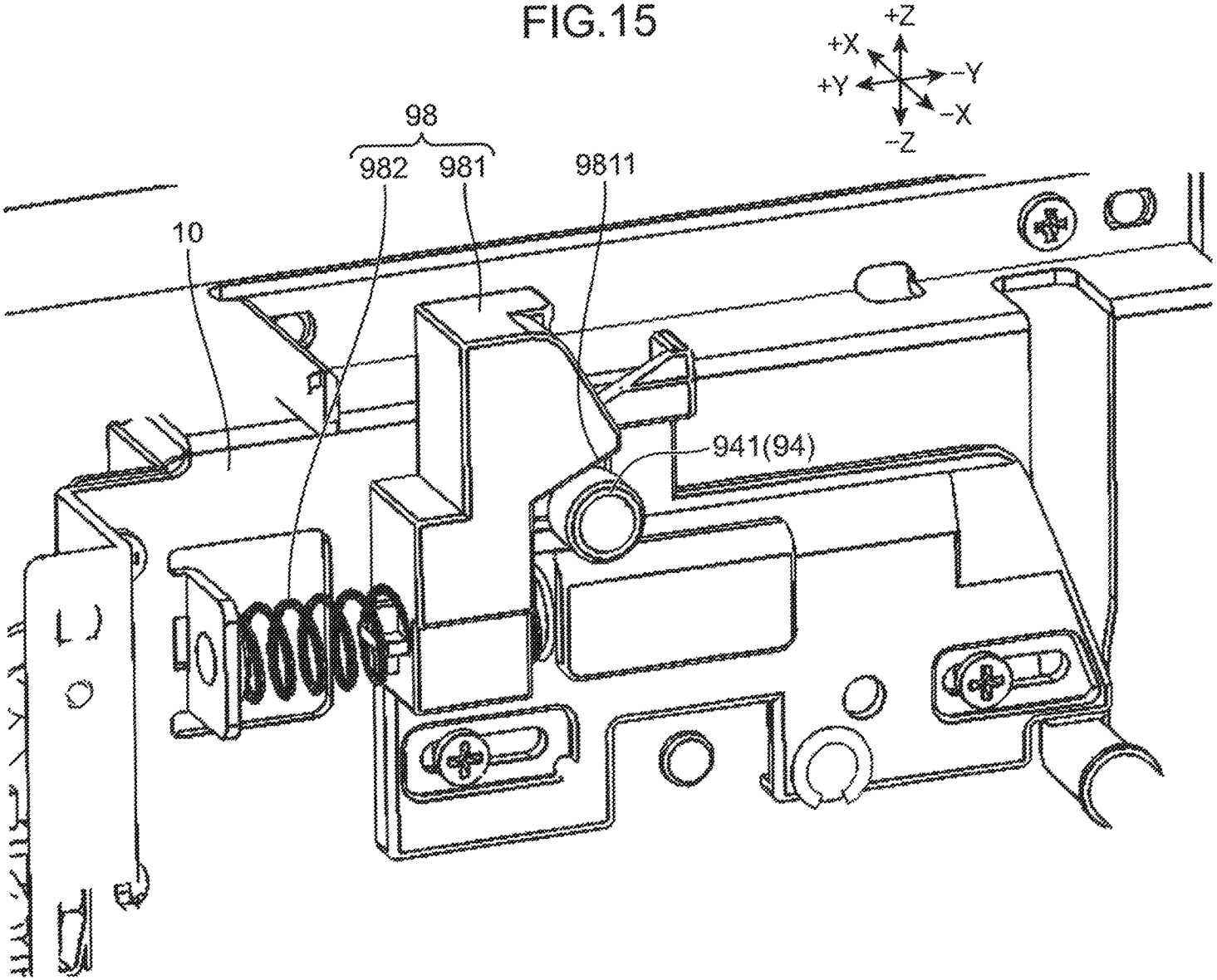
FIG. 15 is an enlarged perspective view of a vicinity of a fixing mechanism in the decurling device.

Next, the fixing mechanism 98 included in the decurling device 60 will be described with reference to FIG. 15 in addition to FIGS. 2, 5, and 11A and 11B. FIG. 15 is an enlarged perspective view of a vicinity of the fixing mechanism 98 in the decurling device 60.

The fixing mechanism 98 positions and fixes the first position adjustment unit 91 disposed in the first support part 611A of the housing 61 to the first frame 60F1. After the position of the first support part 611A of the housing 61 is adjusted by the first position adjustment unit 91, the fixing mechanism 98 positions and fixes the first position adjustment unit 91 to the first frame 60F1. As illustrated in FIG. 15, the fixing mechanism 98 includes a fixing member 981 and an urging member 982.

The fixing member 981 is disposed in the apparatus body 10 so as to be movable in the Y-axis direction on the +X side of the first frame 60F1 within the range of the +Y side of the first position adjustment unit 91. The fixing member 981 has an inclined surface 9811 that is inclined upward to the Y-axis direction. The inclined surface 9811 of the fixing member 981 is inclined from the +Y side to the −Y side so that a leading end side is closer to the +Z side than a proximal end side. The fixing member 981 positions and fixes the first position adjustment unit 91 while the inclined surface 9811 abuts against the head 941 of the fixing pin 94.

The urging member 982 is made of, for example, a coil spring. One end portion of the urging member 982 is connected to the apparatus body 10 and the other end portion of the urging member 982 is connected to the fixing member 981. The urging member 982 urges the fixing member 981 in a direction approaching the first position adjustment unit 91 (direction from +Y side to −Y side). Urging force of the urging member 982 increases abutment force of the fixing member 981 on the head 941 of the fixing pin 94. After the position of the first support part 611A of the housing 61 is adjusted by the first position adjustment unit 91, the first position adjustment unit 91 can be positioned and fixed to the first frame 60F1. The orientation of the decurling unit 60U supported by the first frame 60F1 and the second frame 60F2 is kept.

The present disclosure described above is capable of proving a decurling device that can prevent an endless belt from zigzagging and an image forming apparatus including the decurling device.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A decurling device comprising:

a first frame and a second frame that are disposed to face each other with an interval in a first direction in a horizontal plane and extend in a second direction orthogonal to the first direction;

a decurling unit that is supported by the first frame and the second frame and decurls a sheet on which an image is formed; and a level adjustment mechanism that is capable of adjusting an inclination of the decurling unit to a vertical direction with respect to the first direction, wherein the decurling unit includes a housing that is disposed between the first frame and the second frame including a first end portion and a second end portion in the first direction, a first support part and a second support part that are spaced apart from each other in the second direction at the first end portion and are supported by the first frame, and a third support part and a fourth support part that are spaced apart from each other in the second direction at the second end portion and are supported by the second frame;

paired support rollers that are disposed in the housing to be spaced apart from each other in the second direction, each of the paired support rollers extending in the first direction and including end portions that are rotatably supported at the first end portion and the second end portion of the housing;

an endless belt that is stretched on the paired support rollers and circulates according to rotation of the paired support rollers; and a decurling roller that press-contacts an outer circumferential surface of the endless belt between the paired support rollers to form a nip that has a curved shape together with the endless belt; and wherein the level adjustment mechanism adjusts, in the vertical direction, a position of one of the first support part, the second support part, the third support part, and the fourth support part in the housing to adjust the inclination of the decurling unit in the vertical direction such that the paired support rollers extend in the first direction.

2. The decurling device according to claim 1, wherein the level adjustment mechanism includes a first position adjustment unit that is disposed in the first support part of the housing and adjusts a position of the first support part in the vertical direction, the first position adjustment unit includes a cam member which has a cam surface that abuts against a predetermined abutment target formed in the first frame, the cam surface being divided into a plurality of cam regions with different radii, and the cam member adjusts, in the vertical direction, the position of the first support part in the housing by changing a cam region that abuts against the abutment target of the first frame among the cam regions on the cam surface.

3. The decurling device according to claim 2, wherein the level adjustment mechanism further includes a second position adjustment unit that is disposed in the first frame and adjusts, in the vertical direction, a position of the first support part in the housing by shifting the abutment target in the vertical direction.

4. The decurling device according to claim 3, wherein the second position adjustment unit includes a first plate that is attached to the first frame so as to be movable in the second direction and includes a projecting pin that projects to a side of the second frame; and a second plate that includes an elongated insertion hole defined by a hole end edge into which the projecting pin is inserted and which is inclined upward with respect to the second direction, the second plate being movable in the vertical direction by force that the projecting pin acts on the hole end edge according to a movement of the first plate in the second direction, and wherein the abutment target is formed on an upper edge of the second plate, the second position adjustment unit configured to move the second plate by moving the first plate in the second direction to shift the abutment target in the vertical direction, thus adjusting, in the vertical direction, the position of the first support part in the housing.

5. The decurling device according to claim 2, further comprising a fixing mechanism that positions and fixes the first position adjustment unit to the first frame after the first position adjustment unit adjusts a position of the first support part in the housing, wherein the fixing mechanism includes a fixing member that is disposed to be movable in the second direction, includes an inclined surface which is inclined upward with respect to the second direction, and positions and fixes the first position adjustment unit while the inclined surface abuts against the first position adjustment unit; and an urging member that urges the fixing member toward the first position adjustment unit.

6. An image forming apparatus comprising:

an image forming unit that forms an image on a sheet; and the decurling device according to claim 1, that decurls a sheet on which an image is formed by the image forming unit.

* * * * *